US011316253B2

(12) United States Patent
Park

(10) Patent No.: US 11,316,253 B2
(45) Date of Patent: Apr. 26, 2022

(54) ELECTRONIC DEVICE COMPRISING ANTENNA

(71) Applicant: SAMSUNG ELECTRONICS CO., LTD., Suwon-si (KR)

(72) Inventor: Sung Chul Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/401,356

(22) Filed: Aug. 13, 2021

(65) Prior Publication Data

US 2021/0376449 A1 Dec. 2, 2021

Related U.S. Application Data

(63) Continuation of application No. 16/003,599, filed on Jun. 8, 2018, now Pat. No. 11,189,906.

(30) Foreign Application Priority Data

Jun. 9, 2017 (KR) ..... 10-2017-0072359

(51) Int. Cl.
*H01Q 1/24* (2006.01)
*H01Q 1/22* (2006.01)
(Continued)

(52) U.S. Cl.
CPC ..... *H01Q 1/2283* (2013.01); *H01Q 1/02* (2013.01); *H01Q 1/243* (2013.01); *H01Q 3/40* (2013.01);
(Continued)

(58) Field of Classification Search
CPC ..... H01Q 1/2283; H01Q 1/02; H01Q 1/243; H01Q 3/40; H01Q 5/307; H01Q 9/42;
(Continued)

(56) References Cited

U.S. PATENT DOCUMENTS 8,896,487 B2 11/2014 Chiang et al.
2011/0006953 A1* 1/2011 Chiang ..... G06F 1/1616 343/702
(Continued)

FOREIGN PATENT DOCUMENTS

JP 2015-213285 11/2015
KR 10-2011-0005212 A 1/2011
(Continued)

OTHER PUBLICATIONS

U.S. Appl. No. 16/003,599, filed Jun. 8, 2018; Park.
Korean Office Action dated Aug. 18, 2021 for KR Application No. 10-2017-0072359.

*Primary Examiner* — Awat M Salih
(74) *Attorney, Agent, or Firm* — Nixon & Vanderhye P.C.

(57) ABSTRACT

An electronic device includes a housing including a first plate, a second plate opposite to the first plate, and a side member surrounding a space between the first plate and the second plate, and including at least part of a conductive material, a flexible printed circuit board (FPCB) attached on an inner surface of the housing, a first antenna element which is included in the FPCB and in which a slot is formed, and a first radio frequency integrated circuit (RFIC) for the first antenna element. An opening is formed in the side member or the second plate of the housing. The FPCB is attached the inner surface of the housing such that at least part in which the slot of the first antenna element is formed is exposed through the opening. At least part of the opening is filled with an insulating material.

13 Claims, 18 Drawing Sheets

(51) Int. Cl.

| | |
|---|---|
| ***H01Q 5/307*** | (2015.01) |
| ***H01Q 13/10*** | (2006.01) |
| ***H01Q 3/40*** | (2006.01) |
| ***H01Q 21/08*** | (2006.01) |
| ***H01Q 9/42*** | (2006.01) |
| ***H01Q 21/28*** | (2006.01) |
| ***H01Q 1/02*** | (2006.01) |
| *H01Q 9/28* | (2006.01) |
| *H01Q 9/04* | (2006.01) |

(52) U.S. Cl.
CPC ..... *H01Q 5/307* (2015.01); *H01Q 9/42* (2013.01); *H01Q 13/106* (2013.01); *H01Q 21/08* (2013.01); *H01Q 21/28* (2013.01); *H01Q 9/0407* (2013.01); *H01Q 9/28* (2013.01)

(58) Field of Classification Search
CPC ..... H01Q 9/0407; H01Q 9/28; H01Q 13/106; H01Q 21/08; H01Q 21/28; H04M 1/026; H05K 2201/05
See application file for complete search history.

(56) References Cited

U.S. PATENT DOCUMENTS

| | | | | |
|---|---|---|---|---|
| 2014/0071022 | A1* | 3/2014 | Na | H01Q 9/42 343/904 |
| 2015/0097634 | A1 | 4/2015 | Ghassemi et al. | |
| 2015/0277934 | A1 | 10/2015 | Zhang | |
| 2016/0344439 | A1* | 11/2016 | Seol | H01Q 9/0421 |
| 2018/0277934 | A1* | 9/2018 | Kim | H01Q 1/38 |
| 2019/0312336 | A1* | 10/2019 | Son | H01Q 5/335 |

FOREIGN PATENT DOCUMENTS

| | | | |
|---|---|---|---|
| KR | 10-2014-0033969 | A | 3/2014 |
| KR | 10-2016-0135948 | A | 11/2016 |

* cited by examiner

| Name | Theta | Ang | Mag |
|---|---|---|---|
| m1 | 180.0000 | 180.0000 | 23.0697 |
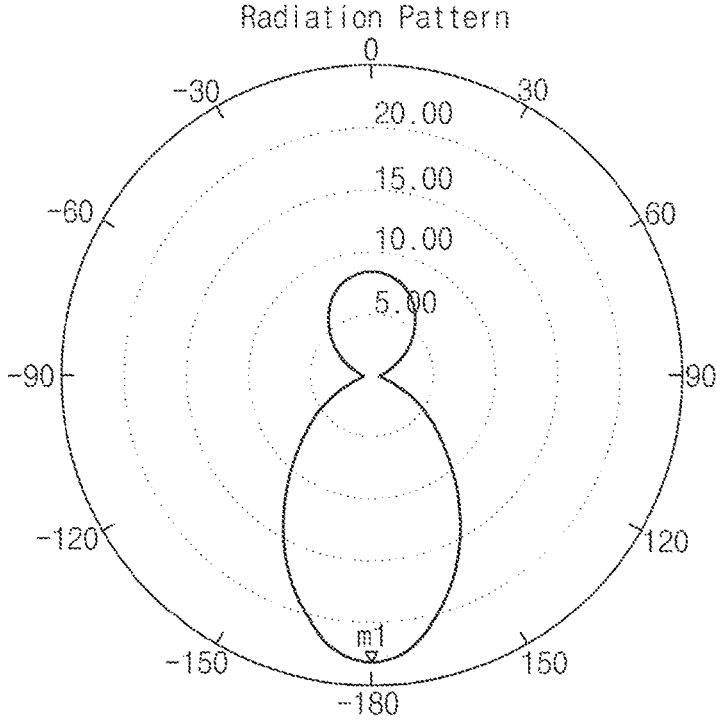
(1)
| Name | X | Y |
|---|---|---|
| m1 | 27.9648 | -7.7133 |
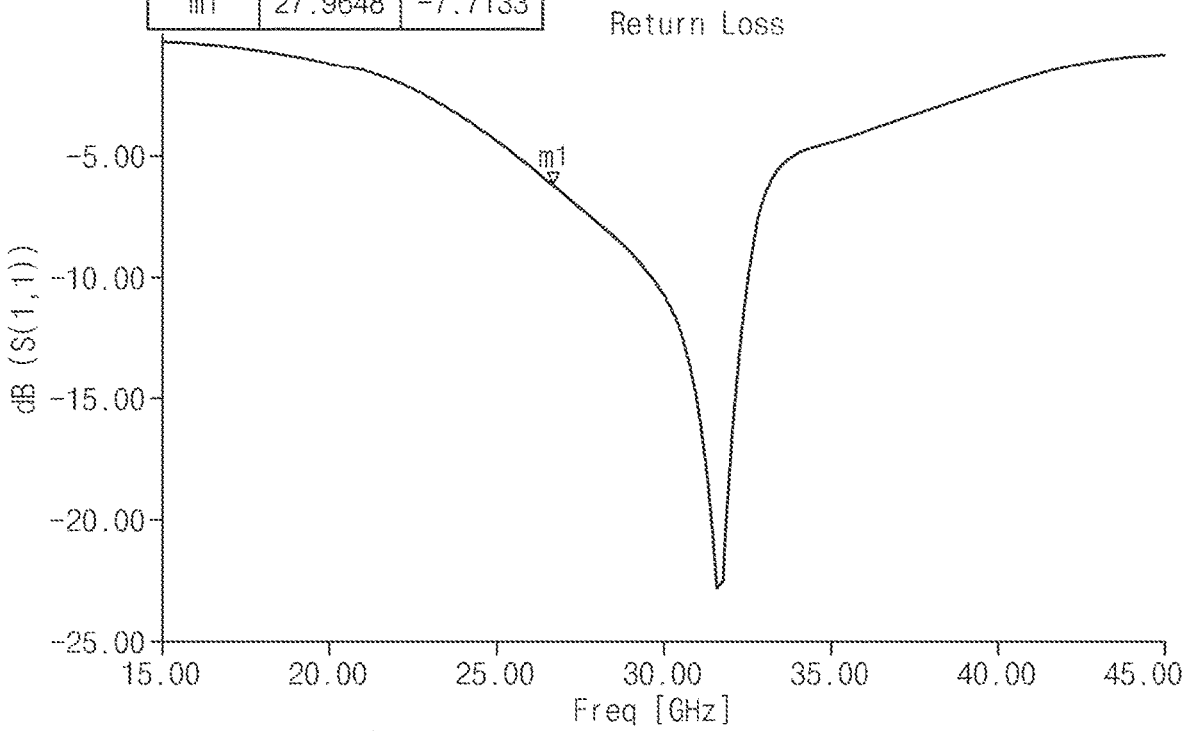
FIG. 7 (2)

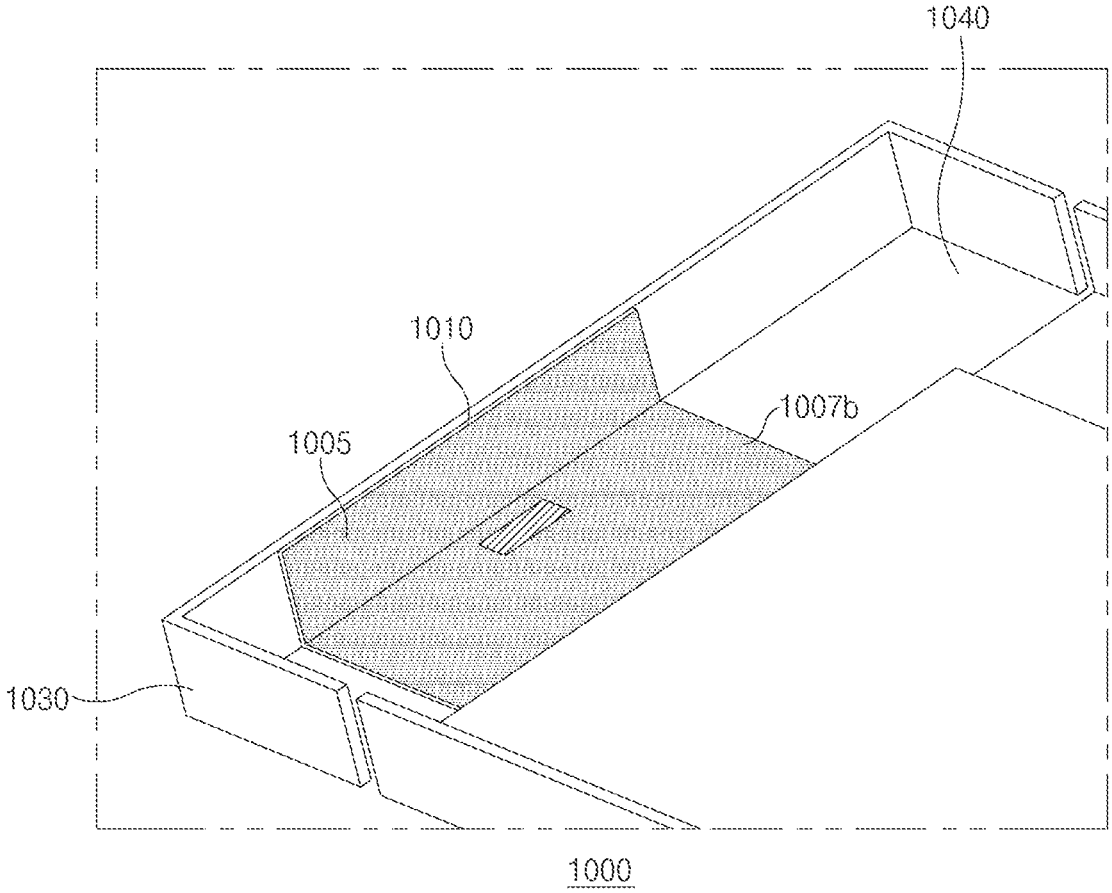
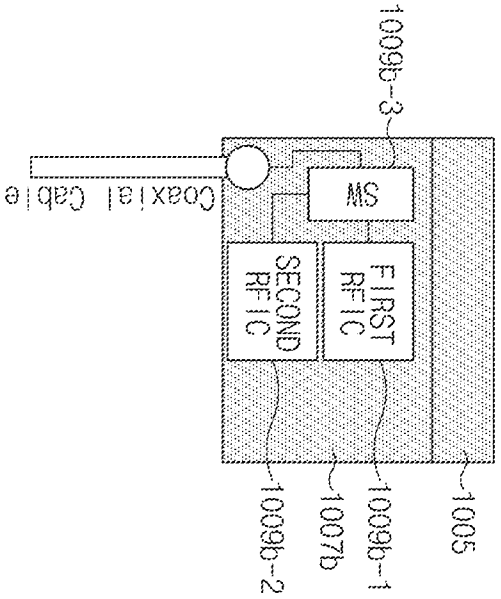
FIG. 11B

ELECTRONIC DEVICE COMPRISING ANTENNA

CROSS-REFERENCE TO RELATED APPLICATION(S)

This application is a Continuation of U.S. application Ser. No. 16/003,599, filed Jun. 8, 2018, which claims priority to KR 10-2017-0072359, filed on Jun. 9, 2017, the entire contents of which are all hereby incorporated herein by reference in their entireties.

BACKGROUND

1. Field

The present disclosure relates to an antenna technology for transmitting and receiving a signal of an extremely high frequency band.

2. Description of Related Art

With the rapid increase in mobile traffic, fifth generation mobile communication (5G) technology based on an extremely high frequency band of 28 GHz or more is being developed. A signal of the extremely high frequency band includes a millimeter wave having a frequency range of 30 GHz to 300 GHz. When the frequency of the extremely high band is used, the wavelength may be short; accordingly, it is possible to make an antenna and a device smaller and lighter. Also, a relatively large number of antennas may be mounted in the same area, and signals may be transmitted in a specific direction. In addition, since the antenna of the extremely high frequency band has wide bandwidth, it is possible to intensively transmit more information.

The above information is presented as background information only to assist with an understanding of the present disclosure. No determination has been made, and no assertion is made, as to whether any of the above might be applicable as prior art with regard to the present disclosure.

SUMMARY

Since the frequency of the extremely high band has a strong straightness and high path loss in the free atmosphere, the frequency of the extremely high band may not be suitable for long-range communication. In addition, a beamforming technology for steering a signal is needed for the purpose of using the extremely high band frequency with strong straightness.

Aspects of the present disclosure are to address at least the above-mentioned problems and/or disadvantages and to provide at least the advantages described below. Accordingly, an aspect of the present disclosure is to provide an electronic device including an antenna using a frequency of an extremely high band.

In accordance with an aspect of the present disclosure, an electronic device includes a housing including a first plate, a second plate opposite to the first plate, and a side member surrounding a space between the first plate and the second plate, and including at least part of a conductive material, a flexible printed circuit board (FPCB) attached on an inner surface of the housing, a first antenna element which is included in the FPCB and in which a slot is formed, and a first radio frequency integrated circuit (RFIC) for the first antenna element. An opening is formed in the side member or the second plate of the housing. The FPCB is attached the inner surface of the housing such that at least part in which the slot of the first antenna element is formed is exposed through the opening. At least part of the opening is filled with an insulating material. The insulating material contacts the at least part in which the slot of the first antenna element is formed.

In accordance with another aspect of the present disclosure, an electronic device includes a housing including a front plate, a back plate facing away from the front plate, and a side member surrounding a space between the front plate and the back plate. The side member includes a conductive portion including at least one opening formed therethrough, and a non-conductive material filling at least part of the at least one opening, a housing, a touchscreen display exposed through the front plate, a FPCB positioned inside the space near the at least one opening, a first wireless communication circuit electrically connected to a first point of the first conductive layer on one side of the first slot, and a second point of the first conductive layer on the other side of the first slot, and a processor electrically connected to the touchscreen display and the first wireless communication circuit. The FPCB includes a first conductive layer including at least one first slot extending along the conductive portion, while facing the opening. The first wireless communication circuit is configured to transmit and/or receive a signal in a range between 20 GHz and 40 GHz.

According to various embodiments of the present disclosure, an antenna for transmitting and/or receiving a signal of an extremely high frequency band having directivity may be implemented. Besides, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 7 illustrates a result of measuring performance of an antenna in which a plurality of holes are added to an FPCB, according to an embodiment of the present disclosure;

FIG. 11B is a view illustrating a mounting form of an FPCB and a PCB, according to another embodiment of the present disclosure;

DETAILED DESCRIPTION

Figure 1:
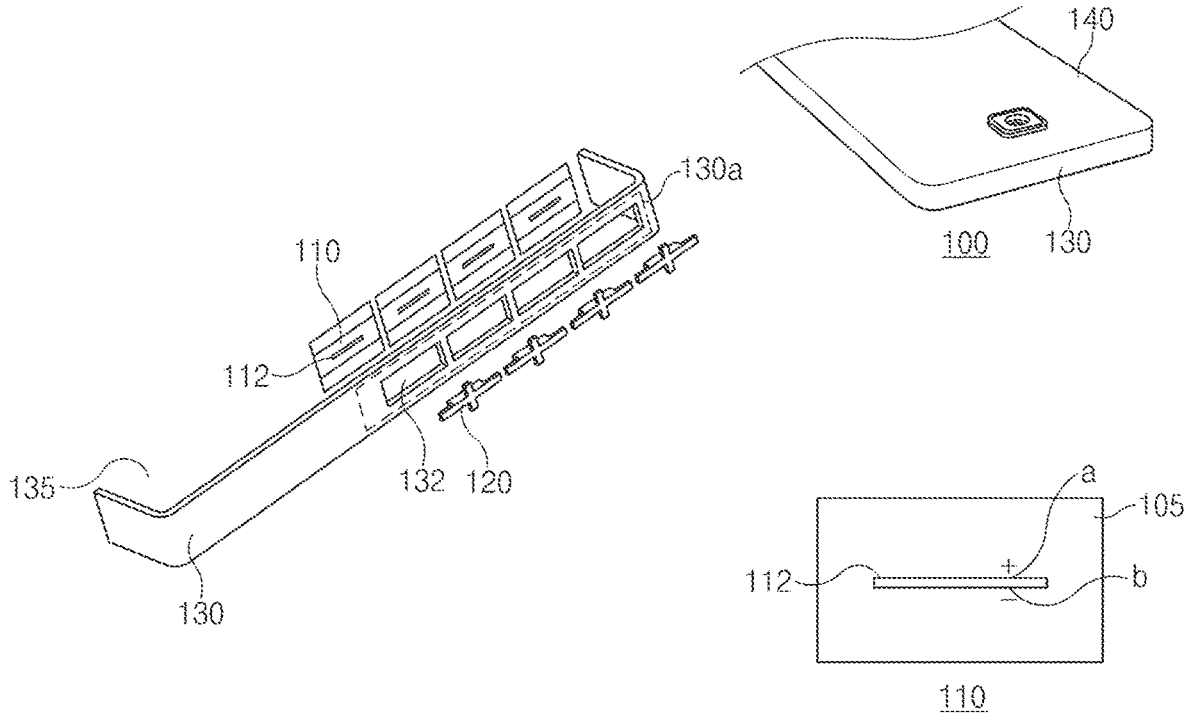
FIG. 1 is a perspective view of an electronic device, according to an embodiment of the present disclosure.

Hereinafter, various embodiments of the present disclosure may be described with reference to accompanying drawings. Accordingly, those of ordinary skill in the art will recognize that modification, equivalent, and/or alternative on the various embodiments described herein can be variously made without departing from the scope and spirit of the present disclosure. With regard to description of drawings, similar elements may be marked by similar reference numerals.

In this disclosure, the expressions "have", "may have", "include" and "comprise", or "may include" and "may comprise" used herein indicate existence of corresponding features (e.g., elements such as numeric values, functions, operations, or components) but do not exclude presence of additional features.

In this disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used in this disclosure may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which performs corresponding operations by executing one or more software programs which are stored in a memory device.

Terms used in this disclosure are used to describe specified embodiments and are not intended to limit the scope of the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are terms which are defined in this disclosure, they may not be interpreted to exclude embodiments of this disclosure.

An electronic device according to various embodiments of this disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or Play Station™), electronic dictionaries, electronic keys, camcorders, electronic picture frames, and the like.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of this disclosure may not be limited to the above-described electronic devices and may include other electronic devices and new electronic devices according to the development of technologies.

Hereinafter, electronic devices according to various embodiments will be described with reference to the accompanying drawings. In this disclosure, the term "user" may refer to a person who uses an electronic device or may refer to a device (e.g., an artificial intelligence electronic device) that uses the electronic device.

FIG. 1 is a perspective view of an electronic device, according to an embodiment of the present disclosure.

Referring to FIG. 1, an electronic device 100 according to an example embodiment may be surrounded by a housing. The housing of the electronic device 100 may include a first plate, a second plate 140 opposite to the first plate, and a side member 130 surrounding the space between the first plate and the second plate 140. At least a portion of the housing may include a conductive material.

In an example embodiment, the electronic device 100 may include a first antenna element 110. The first antenna element 110 may be, but is not limited to, a slot antenna. For example, the first antenna element 110 may be a patch antenna, a dipole antenna, or an end fire antenna. Hereinafter, the case the first antenna element 110 is a slot antenna will be described as one example.

In an example embodiment, the electronic device 100 may include the first antenna element 110 in which a slot 112 is formed. For example, the intermediate frequency of the first antenna element 110 may be 28 GHz. However, embodiments of the present disclosure are not limited thereto. For example, the first antenna element 110 may transmit and/or receive millimeter waves including a frequency signal of about 20 GHz to about 60 GHz.

Referring to FIG. 1, an embodiment is exemplified as the electronic device 100 in which four first antenna elements 110 are coupled to the side member 130 of the housing, and four corresponding openings 132 are defined in the side member 130 of the housing. However, embodiments of the present disclosure are not limited thereto. For example, the first antenna element(s) 110 may be formed in the side member 130 or the second plate 140. For another example, a plurality of first antenna elements 110 may be formed in consideration of the area of the side member 130 or the second plate 140.

In an example embodiment, the electronic device 100 may include a flexible printed circuit board (FPCB) 105 attached to the inner surface of the housing and having the first antenna element 110 formed thereon. Since the FPCB 105 has ductility, the FPCB 105 may be bent, and thus the FPCB 105 may be positioned adjacent to or attached to the inner surface of the housing.

In an example embodiment, the electronic device 100 may include a first radio frequency integrated circuit (RFIC) for the first antenna element(s) 110. The first RFIC may include all electronic circuits operating in a frequency range suitable for wireless communication. For example, the first RFIC may be configured to transmit and/or receive signals between about 20 GHz and about 60 GHz. The first RFIC may include a feeding circuit for feeding the first antenna element 110.

In an embodiment, at least one opening 132 may be formed in the side member 130 or the second plate 140 of the housing.

In an embodiment, the FPCB 105 may be attached to the inner surface of the housing such that at least a portion in which the slot 112 of the first antenna element 110 is formed is exposed through the opening 132. The first antenna element 110 may transmit or receive a signal through the opening 132. The opening 132 may serve as a director that allows the signal radiated from the first antenna element 110 to have directivity.

In an embodiment, at least a portion of the opening 132 may be filled with the insulating material 120. Referring to FIG. 1, it is illustrated that a portion of the opening 132 is filled with a cross shape member of insulating material 120. The insulating material 120 may be filled such that a portion of the insulating material 120 of the cross shape contacts the side member 130, and thus the insulating material 120 may support an appearance of the electronic device 100 together with a housing. In various embodiments, the insulating material 120 may be in the form of a straight shape, an 11-character shape, a square shape, or a shape the same as the opening 132 to contact a portion of the side member.

In an example embodiment, the insulating material 120 may be in contact with the first antenna element 110. For example, the insulating material 120 may be in contact with at least a portion of the first antenna element 110 in which the slot 112 is formed. For another example, the insulating material 120 may be attached to or coupled to the slot 112. For another example, the insulating material 120 may be disposed adjacent to the first antenna element 110. Hereinafter, the case where the insulating material 120 contacts the slot 112 will be described as an embodiment, but not limited thereto.

In an embodiment, the insulating material 120 may allow the FPCB 105 to be adhered well to the inner surface of the housing. The insulating material 120 may support the appearance of the electronic device 100 together with the housing. The insulating material 120 may serve as a director that allows the signal radiated from the first antenna element 110 to have directivity, by contacting the first antenna element 110.

In an embodiment, the permittivity of the insulating material 120 may affect the radiation of the first antenna element 110. For example, as the permittivity of the insulating material is higher, the directivity may increase and the loss of signal may also increase.

In various embodiments, the directivity of the signal may increase by arranging a plurality of the first antenna elements 110 in a row in the electronic device 100. The feeding circuit of the first RFIC may feed each of the plurality of first antenna elements 110, and each of the first antenna elements 110 may be fed in the same phase.

In an embodiment, at least one slot 112 may be formed in the first antenna element 110. The first antenna element 110 may be fed through 'a' point by the feeding circuit. For example, the first antenna element 110 may operate as a slot antenna.

In another example embodiment, the electronic device 100 may include a front plate, a back plate 140 facing away from the front plate, and a side member 130 surrounding a space between the front plate and the back plate 140. The side member 130 may include a conductive portion 130*a* including at least one opening 132 defined therein. At least part of the at least one opening 132 may be filled with a non-conductive material 120.

In another embodiment, the electronic device 100 may include an FPCB 105 positioned adjacent to the at least one opening 132 inside the space 135. The FPCB 105 may include a first conductive layer 110. The first conductive layer 110 may include at least one slot 112 that extends along the conductive portion 130*a* while facing the opening 132.

In another embodiment, the electronic device 100 may include a wireless communication circuit. The wireless communication circuit may be electrically connected to first point 'a' of the first conductive layer on one side of the slot 112 and second point 'b' of the first conductive layer on the other side of the slot 112. The wireless communication circuit may be configured to transmit and/or receive a signal between about 20 GHz and about 70 GHz.

In various embodiments, an area of the side member 130 of the electronic device 100 other than the conductive portion 130*a* may include an antenna radiator that transmits and receives a signal of a band of 20 GHz or less. For example, an antenna (e.g., the first antenna element 110) for performing fifth-generation mobile communication and an antenna for performing fourth-generation mobile communication may be mounted in the side member 130.

Figure 2:
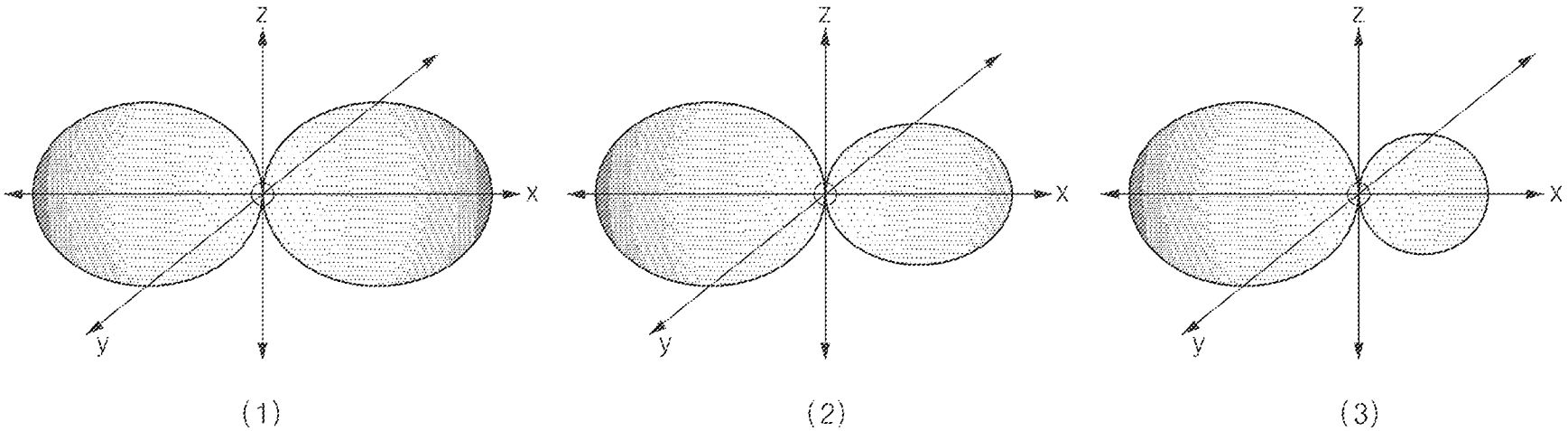
FIG. 2 is a view for describing directivity of an antenna element, according to an embodiment of the present disclosure.

FIG. 2 is a view for describing directivity of an antenna element, according to an embodiment of the present disclosure.

In one experimental example, the directivity of the first antenna element 110 of the electronic device 100 illustrated in FIG. 1 is measured. In one experimental example, the electronic device 100 has four first antenna elements 110 arranged in a row and the side member 130 (e.g., a metal bezel) including a conductive material. The illustrated graph '1' to graph '3' represents the beam pattern of the first antenna elements 100. The '−x' axis is the outward direction of the housing, and the '+x' axis is the inward direction of the housing.

The graph '1' is a graph obtained by measuring the directivity of the first antenna element 110 without the insulating material 120 and the side member 130. The signal of the first antenna element 110 is radiated evenly in the outward direction '−x' and the inward direction '+x'.

The graph '2' is a graph obtained by measuring the directivity of the first antenna element 110 that the insulating material 120 contacts. The first antenna element 110 radiates more signals in the outward direction '−x'. For example, the insulating material 120 may serve as a support and a director.

The graph '3' obtained by measuring the directivity of the first antenna element 110 to which the side member 130 including at least one opening 132 is attached, while the insulating material 130 fills at least one opening 132 of the side member 132. The case may be the case where the FPCB 105 is attached to the side member 130 of a housing such that the first antenna element 110 contacts the insulating material 120 and at least part of the first antenna element 110 is exposed through the opening 132.

Referring to the graph '3', it is verified that the first antenna element 110 radiates more signals in the outward direction '−x' of the housing. The opening 132 of the side member 130 may serve as a director together with the insulating material 120.

Figure 3:
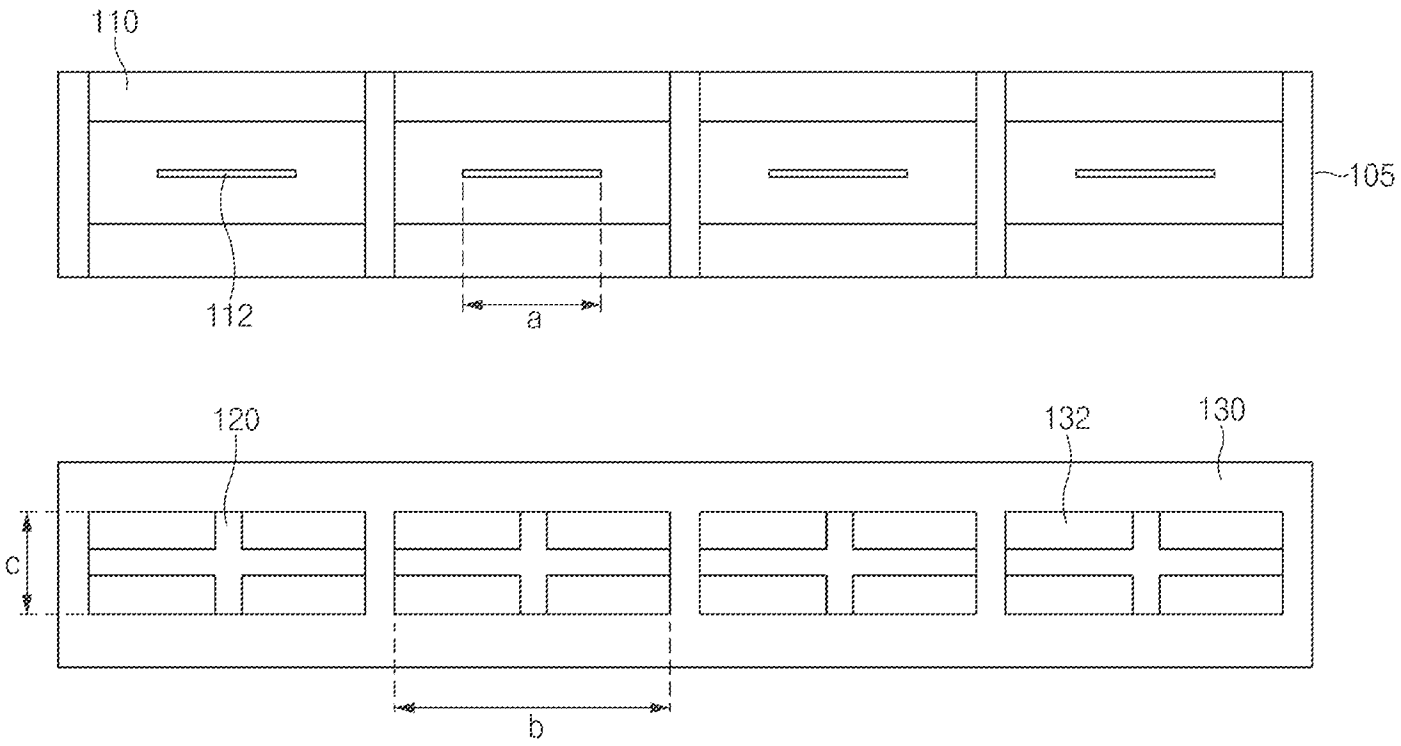
FIG. 3 illustrates an example of an antenna element, according to an embodiment of the present disclosure.

FIG. 3 illustrates an example of an antenna element, according to an embodiment of the present disclosure.

Referring to FIG. 3, the first antenna element 110 according to an embodiment may be formed in the FPCB 105. The first antenna element 110 may include the slot 112. For example, the first antenna element 110 may be referred to as a "slot antenna". For example, the slot 112 may have length 'a' of about 5 mm for the purpose of transmitting a signal with an intermediate frequency of 28 GHz.

According to an embodiment, the opening 132 of the housing may have horizontal length 'b' of about 9.1 mm and vertical length 'c' of about 3.4 mm. The FPCB 105 may be disposed on the inner surface of the housing such that the slot 112 is exposed to the outside through the opening 132 of the housing. The opening 132 may be formed in the side member 130 of the housing or in the second plate 140.

According to an embodiment, the insulating material 120 may have an area including the slot 112. For another example, the insulating material 120 may be contacted, attached or coupled to the first antenna element 110 to cover the slot 112. The insulating material 120 may be attached or coupled to the first antenna element 110 to support the FPCB 105 to be attached to the inner surface of the housing. For another example, the insulating material 120 may overlap with the slot 112 and may be formed adjacent to the first antenna element 110.

According to an embodiment, the insulating material 120 may have an area the same as or similar to the area included in the opening 132. The insulating material 120 may be coupled to the housing by penetrating the opening 132. The insulating material 120 may be coupled to the housing to form and support the external shape of the electronic device 100. The insulating material 120 may be formed in a cross shape, a straight shape, a circular shape, or the like, but is not limited thereto. The insulating material 120 may include all the shapes capable of being coupled to the side member 130 through the opening 132.

Figure 4:
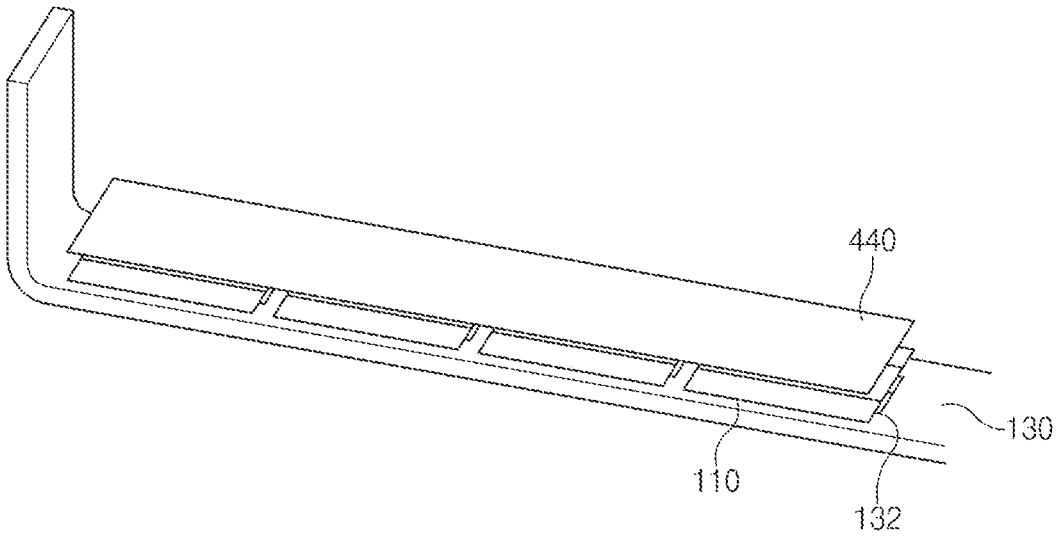
FIG. 4 is a perspective view of an electronic device including an antenna reflector for improving directivity of an antenna element, according to an embodiment of the present disclosure.
Figure 5:
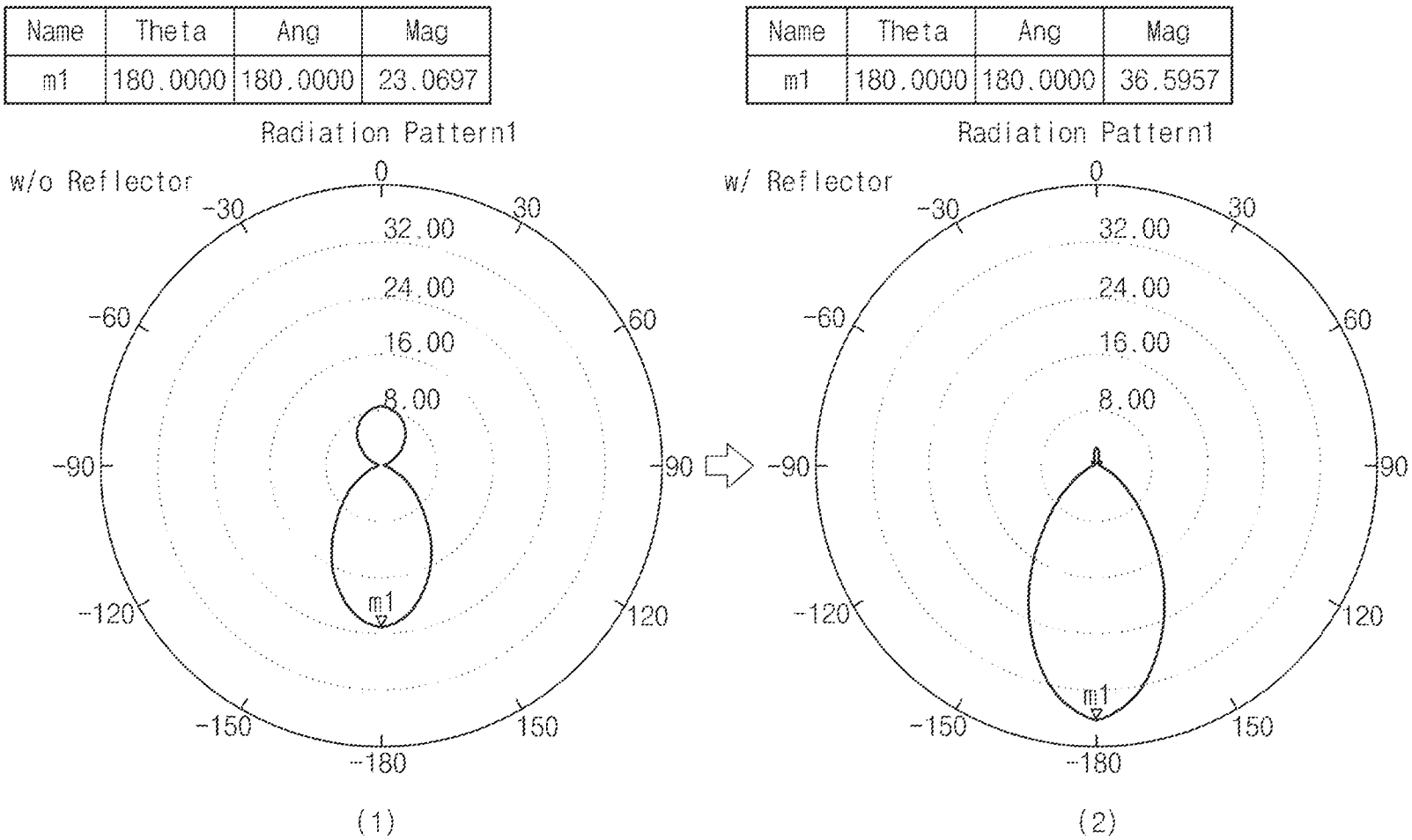
FIG. 5 is a view for describing directivity improved as an antenna reflector is added, according to an embodiment of the present disclosure.

FIG. 4 is a perspective view of an electronic device including an antenna reflector for improving directivity of an antenna element, according to an embodiment of the present disclosure. FIG. 5 is a view for describing directivity improved as an antenna reflector is added, according to an embodiment of the present disclosure.

Referring to FIG. 4, the electronic device 100 (e.g., the electronic device 100 of FIG. 1) may further include an antenna reflector 440 accommodated inside a housing. The first antenna element 110 of the electronic device 100 may be interposed between the opening 132 and the antenna reflector 440.

According to an embodiment, the antenna reflector 440 may be referred to as a "reflector". A signal facing in the inward direction of the housing among signals of the first antenna element 110 may be reflected by the reflector and may face in the outward direction thereof.

Referring to FIG. 5, radiation pattern1 without the antenna reflector 440 and radiation pattern2 with the antenna reflector 440 in the electronic device 100 are illustrated. In one experimental example, the directivity of an antenna is measured by adding the antenna reflector 440 to the electronic device 100 described in the experimental example of FIG. 2.

It is understood that, in radiation pattern2, the signal facing in the 0-degree direction is added to the signal facing in the '−180'-degree direction and thus the antenna gain increases. The specific figures are illustrated in Table 1 below. It is understood that the antenna gain is improved by about 1 dB.

TABLE 1

| | The case where there is no reflector | The case where there is a reflector |
|---|---|---|
| Antenna gain (dB) | 12.86 dB | 13.78 dB |

Figure 6:
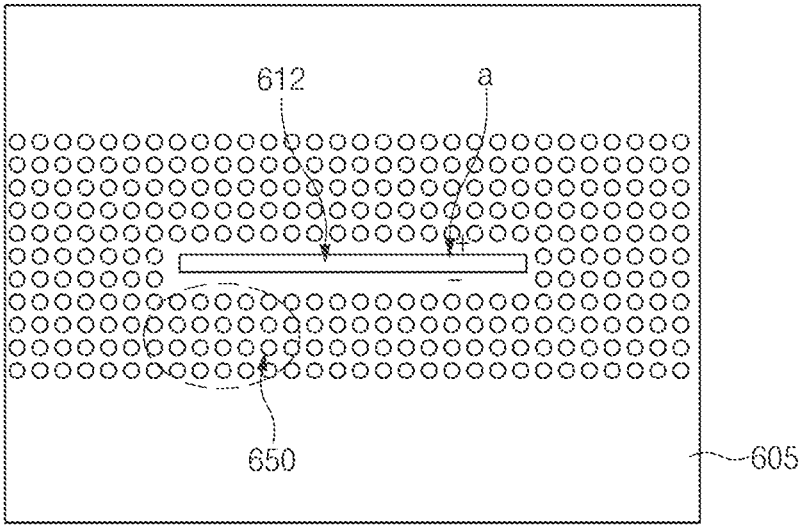
FIG. 6 is a sectional view of a FPCB including a plurality of holes, according to an embodiment of the present disclosure.

FIG. 6 is a sectional view of a FPCB including a plurality of holes, according to an embodiment of the present disclosure. FIG. 7 illustrates a result of measuring performance of an antenna in which a plurality of holes are added to an FPCB, according to an embodiment of the present disclosure.

Referring to FIG. 6, an FPCB 605 (e.g., the FPCB 105 of FIG. 1) of an electronic device (e.g., the electronic device 100 of FIG. 1) according to an embodiment of the present disclosure may include the plurality of holes 650. The plurality of holes 650 may be positioned to face an opening (e.g., the opening 132 of FIG. 1) of a housing. An embodiment is exemplified as the plurality of holes 650 are circular shapes. However, the shape of each of the plurality of holes 650 is not limited to a circular shape.

According to an embodiment, when the FPCB 605 is attached to the inner surface of the housing, the flow of air between the inside of the housing and the outside of the housing may be impeded or blocked. The plurality of holes 650 may serve as an air path by allowing air to flow between the inside of the housing and the outside of the housing.

For example, in the case where a speaker is built in the electronic device, the plurality of holes 650 may allow the sound of the speaker to be output outside the housing. For another example, in the case where a microphone is built in the electronic device, the external sound may be transmitted to the inside through the plurality of holes 650. For another example, in the case where a cooler is built in the electronic device, the plurality of holes 650 may allow air to flow from the outside and may allow the internal heat to emit to the outside.

According to an embodiment, when the plurality of holes 650 is included in the FPCB 605, a first antenna element may include a part of the plurality of holes 650. For example, the first conductive layer of the FPCB 605 may be adjacent to the slot 612 so as to include the plurality of holes 650. In the case where the plurality of holes 650 are absent in the first antenna element and in the case where the plurality of holes 650 are present in the first antenna element, the result of measuring the antenna performance is shown in FIG. 7. The first antenna element in FIG. 6 may be fed through 'a' point (e.g., 'a' point of FIG. 1).

Referring to FIG. 7, radiation pattern (1) indicates that the beam pattern of the antenna faces toward the outside of the housing, and graph (2) of return loss indicates that the antenna is resonating between about 28 GHz and about 33 GHz.

Referring to Table 2, with regard to the case where the first antenna element is one and the case where first antenna elements are four (e.g., the plurality of first antenna elements 110 having four rows illustrated in FIG. 1), the result of measuring the antenna gain of an antenna element is illustrated. It is understood that the performance is not significantly degraded as compared with the case of a slot antenna without a hole.

TABLE 2

| | The case where there is no hole | The case where there is a hole |
|---|---|---|
| Single antenna | 4.47 dB | 5.69 dB |
| Four row antennas | 12.86 dB | 12.85 dB |

Figure 8:
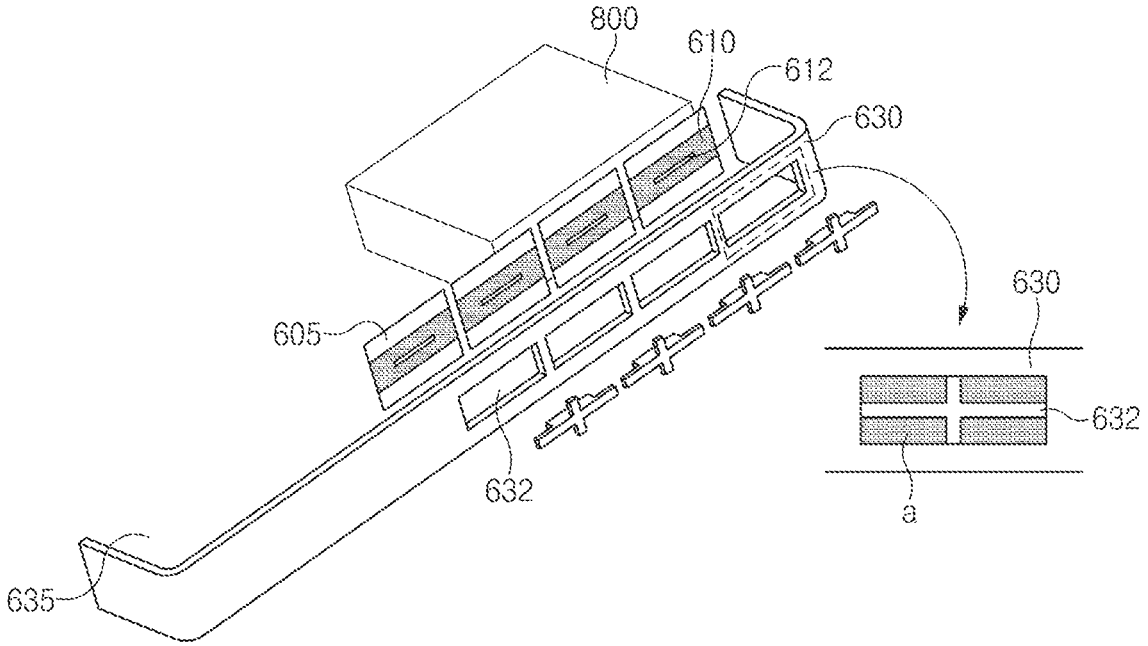
FIG. 8 is a perspective view of an electronic device in which a speaker is mounted, according to an embodiment of the present disclosure.

FIG. 8 is a perspective view of an electronic device in which a speaker is mounted, according to an embodiment of the present disclosure.

Referring to FIG. 8, according to an embodiment, an electronic device (e.g., the electronic device 100 of FIG. 1) may further include a speaker 800 accommodated inside the housing of the electronic device. The speaker 800 may be referred to as a "speaker module". For example, an opening 632 of the housing may be formed in a side member 630 of the housing. The speaker 800 may be disposed on a surface opposite to the surface of the FPCB 605 facing the opening 632. The sound of the speaker 800 may be output to the outside through the plurality of holes 650 positioned to face the opening 632.

According to another embodiment, the speaker module 800 may be positioned in a space 635 (e.g., the space 135 of FIG. 1) between a front plate and a back plate such that the first conductive layer 610 is interposed between the speaker module 800 and the side member 630. The first conductive layer 610 may include a plurality of through-holes (e.g., the plurality of holes 650 of FIG. 6) adjacent to at least one slot 612 (e.g., the slot 112 of FIG. 1). Through the plurality of through-holes, the sound of the speaker module 800 may be output to the outside.

According to another embodiment, the non-conductive material 620 and the conductive portion formed in a portion of the side member 630 together may form at least one gap that serves as a sound conduit of the speaker module 800. For example, the conductive portion and the non-conductive material 620 may form four gaps such as a shaded portion (region a). Through the gap, the sound of the speaker module 800 therein may be output to the outside.

According to various embodiments, an antenna reflector (e.g., the antenna reflector 440 of FIG. 4) may be attached to the enclosure of the speaker 600. Although not illustrated in FIG. 8, for example, the antenna reflector may be attached to the enclosure of the speaker 800 and may be positioned between the speaker 800 and the first antenna element 610. As such, the performance of the first antenna element 610 may be improved. For example, depending on the attachment position of the antenna reflector, it is possible to form an air path capable of outputting the sound of the speaker 800 to the outside. For example, a plurality of holes may be formed in the antenna reflector.

Figure 9:
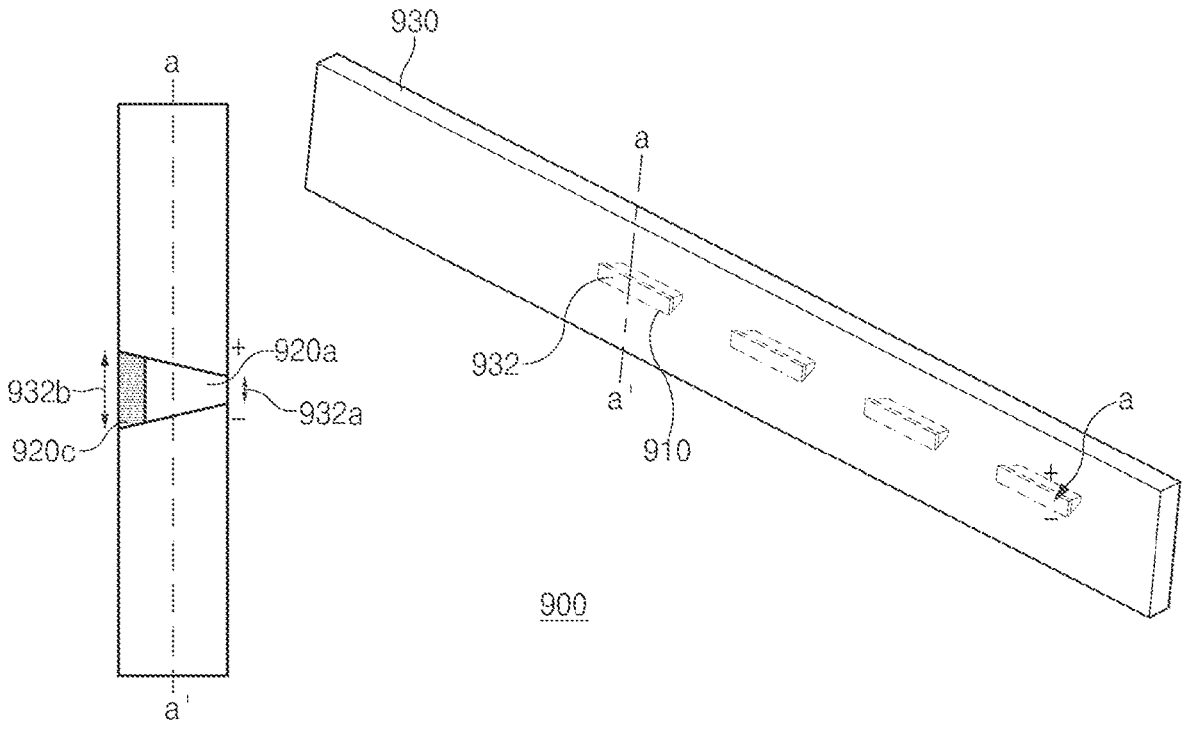
FIG. 9 is a perspective view of an electronic device, according to another embodiment of the present disclosure.

FIG. 9 is a perspective view of an electronic device, according to another example embodiment of the present disclosure.

Referring to FIG. 9, the housing of an electronic device 900 (e.g., the electronic device 100 of FIG. 1) may include a first plate, a second plate (e.g., the second plate 140 of FIG. 1) opposite to the first plate, and a side member 930 (e.g., the side member 130 of FIG. 1) surrounding a space between the first plate and the second plate. At least a portion of the housing may include a conductive material such as metal.

According to an embodiment, the side member 930 may be formed adjacent first antenna element 910. At least part of the side member 930 may include a conductive material. An example embodiment is exemplified in FIG. 9 where four first antenna elements 910 are arranged in a row. However, embodiments are not limited thereto.

In an embodiment, an opening 932 may be formed in the first antenna element 910 and/or side member 930. The opening 932 may be filled with an insulating material. The insulating material may improve the directivity of the first antenna element 910.

In an embodiment, the electronic device 900 may include an FPCB accommodated inside the housing. The FPCB may include a first RFIC for feeding the first antenna element(s) 910. The first RFIC may feed the opening 932. For example, the first RFIC may include a feeding circuit for feeding the first antenna element(s) 910.

In an embodiment, the width of the opening 932*a* of the inner surface of the housing may be smaller than the width of the opening 932*b* of the outer surface of the housing. Referring to the cross-sectional view of section a-a' of the side member 930, the cross-sectional view of opening 932 may have a trapezoidal shape.

For example, the side member 930 of the housing may be a metal body having a specific thickness. The cross section of the opening 932 included in the side member 930 may have a trapezoidal shape, the height of which is a specific thickness. The opening 932 of the shape may serve as the director of the first antenna element 910.

In an embodiment, the insulating material may include a metal oxide 920*b* that fills the outer portion of the housing or an insulating material 920*a*, which is different from the metal oxide and which fills the inner portion of the housing. For example, the side member 930 of the housing may be formed of aluminum, and the metal oxide 920*b* may be aluminum oxide.

Figure 10A:
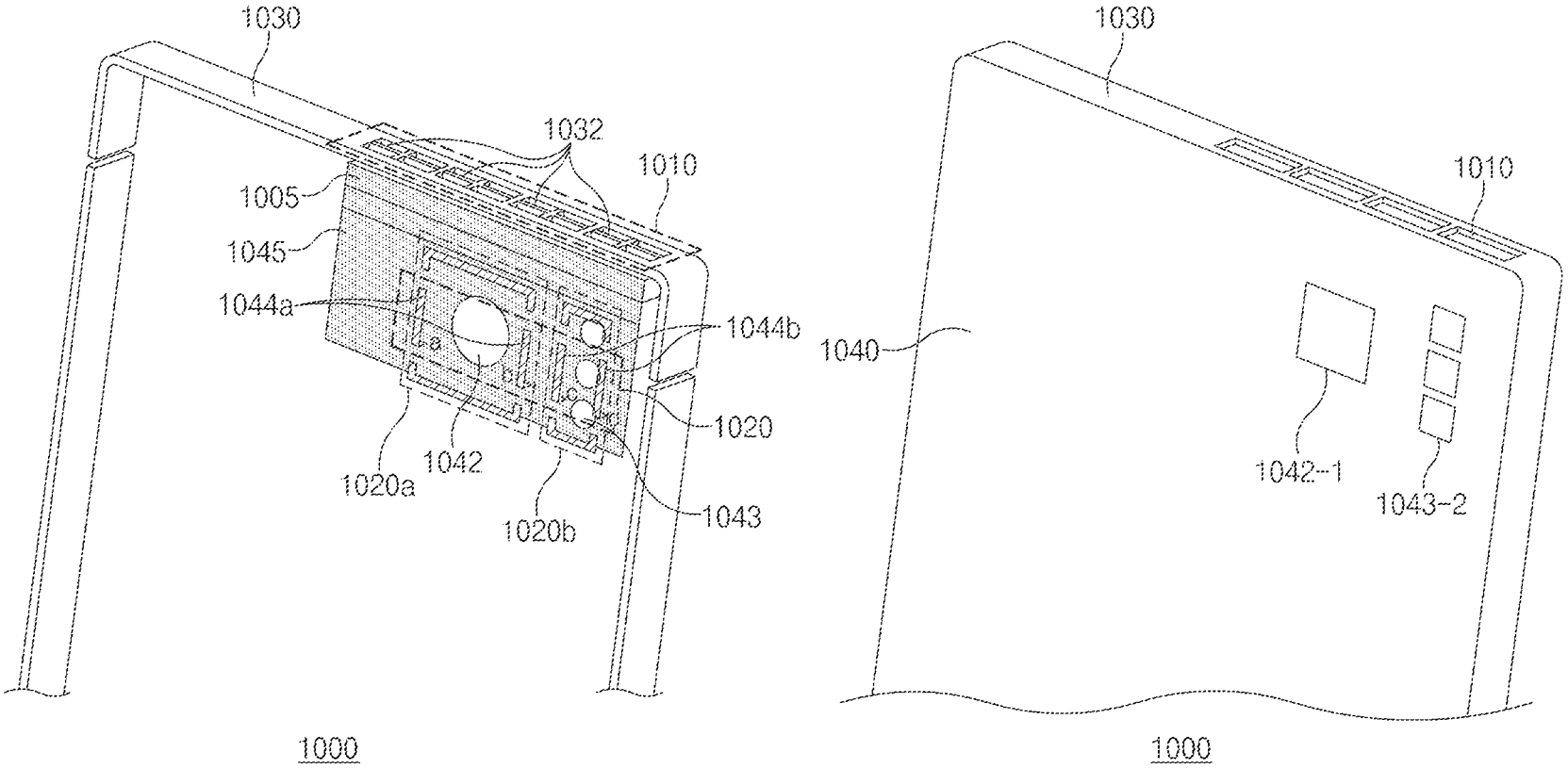
FIGS. 10A and 10B are perspective views of an electronic device in which a plurality of antenna elements are mounted, according to another embodiment of the present disclosure.
Figure 10B:
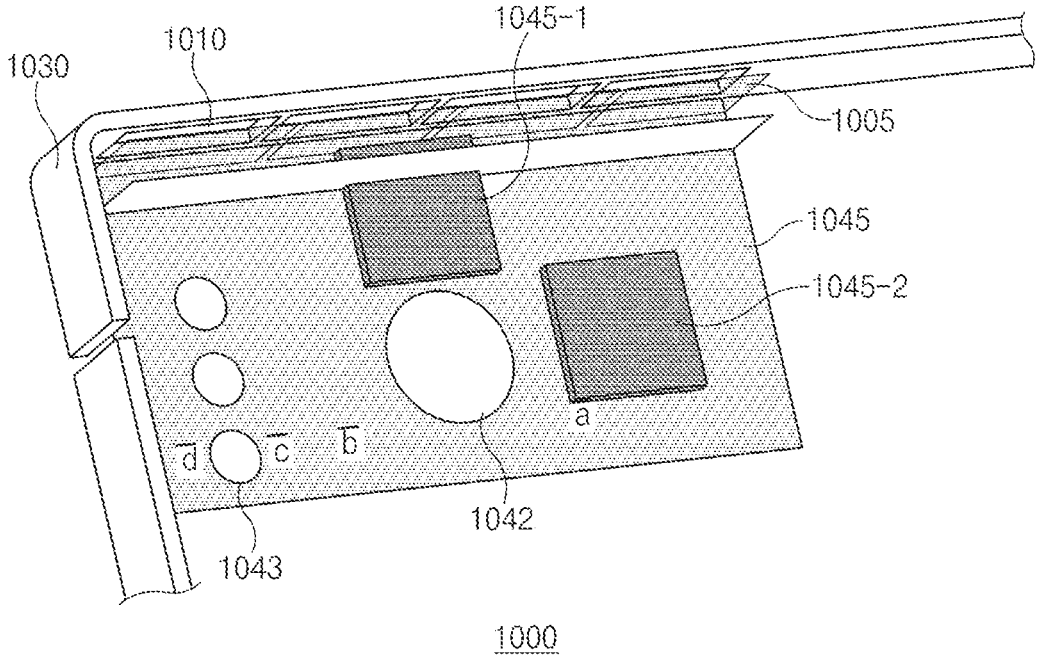

FIGS. 10A and 10B are perspective views of an electronic device in which a plurality of antenna elements are mounted, according to another embodiment of the present disclosure.

According to an embodiment, a first opening(s) 1032 (e.g., the opening 132 of FIG. 1 or opening 932) of an electronic device 1000 (e.g., the electronic device 100 of FIG. 1 or the electronic device 900 of FIG. 9) may be formed in the side member 1030 (e.g., the side member 130 of FIG. 1 or the side member 930 of FIG. 9). The first antenna element(s) 1010 (e.g., the first antenna element 110 of FIG. 1 or the first antenna element 910 of FIG. 9) may be formed adjacent to the side member 1030. FIGS. 10A and 10B illustrate the first antenna element 110 of FIG. 1 as an example of a first antenna element 1010. According to an embodiment, the RFIC for the first antenna element 110 may be positioned on the second PCB 1045.

In an embodiment, the electronic device 1000 may include another second antenna element 1020 formed in the second plate 1040.

Since a signal of the extremely high frequency band has strong straightness, the first antenna element 1010 may receive a signal coming into the side member 1030, but it may be relatively difficult to receive a signal coming into the second plate 1040. The second antenna element 1020 formed in the second plate 1040 may transmit or receive signals coming from the rear surface thereof.

According to an embodiment, the second plate 1040 may include a second opening 1042-1 and a third opening(s) 1043-2. For example, the second opening 1042-1 may be an opening for mounting a camera. For example, the third opening 1043-1 may be an opening for mounting a sensor. The sensor may include a heart rate sensor, an illumination sensor, and the like.

In an embodiment, the second PCB 1045 may include openings 1042 and 1043 corresponding to the second opening 1042-1 and the third opening 1043-2, respectively. For example, a camera or sensor may be disposed by penetrating the openings 1042 and 1043 of the second PCB 1045.

In an embodiment, the second PCB 1045 may include a camera deco 1002*a* for mounting the camera and a sensor deco 1002*b* for mounting the sensor.

In an embodiment, the second PCB 1045 may include conductive patterns 1044*a* and 1044*b* disposed adjacent to the second opening 1042-1 or the third opening 1043-2 of the second plate 1040. For example, the conductive patterns 1044*a* and 1044*b* may be fed and may serve as a radiator of a monopole antenna. The signal of the monopole antenna may be radiated through the second opening 1042-1 and the third opening 1043-2 of the second plate 1040. For example, the camera deco 1020*a* and the sensor deco 1020*b* may include the conductive patterns 1044*a* and 1044*b*.

Referring to FIGS. 10A and 10B, for example, the camera deco 1020*a* may include two conductive patterns 1044*a*, and the sensor deco 1020*b* may include two conductive patterns 1044*b*. Four conductive patterns may be fed through points 'a' to 'd' and may serve as radiators for four monopole antennas. For example, the RFIC positioned on the second PCB 1045 may feed points 'a' to 'd'.

In an embodiment, the conductive patterns 1044*a* and 1044*b* may transmit and/or receive signals between about 20 GHz and about 70 GHz. However, embodiments are not limited thereto. The conductive patterns 1044*a* and 1044*b* may be implemented with different patterns for transmitting and/or receiving different target frequencies.

In an embodiment, the partial region of the camera deco 1020*a* and the sensor deco 1020*b* may be referred to as a "second antenna element 1020". In another embodiment, the partial region of the camera deco 1020*a* or the sensor deco 1020*b* may be referred to as a "second antenna element 1020". Each of the camera deco 1020*a* and the sensor deco 1020*b* may include a conductive pattern, and a plurality of conductive patterns may operate as a set of antenna radiators.

In an embodiment, the at least part of the second antenna element 1020 may be positioned to be exposed through the second opening 1042-1 and the third opening 1043-2. The signal of the second antenna element 1030 may be transmitted to the outside through the second opening 1042-1 and the third opening 1043-2.

In one experimental example, the antenna gains of a plurality of antenna elements illustrated in FIGS. 10A and 10B are measured. The antenna gains are measured with respect to both the case where the first antenna element 1010 and the second antenna element 1020 are separately mounted on the electronic device 1000 and the case where the two antenna elements were mounted simultaneously.

Referring to Table 3 below, the performance of antennas are measured when each of the antennas was used separately is nearly equal to the performance of antennas are measured when the antennas are used at the same time. Accordingly, the antenna of the side member 1030 and the antenna of the second plate 1040 are simultaneously mounted, and thus the electronic device 1000 may transmit and/or receive signals in different directions.

TABLE 3

| | Using antenna alone | Using antennas at the same time |
|---|---|---|
| First antenna element 1010 | 13.68 dB | 13.28 dB |
| Second antenna element 1020 | 14.00 dB | 13.98 dB |

Figure 11A:
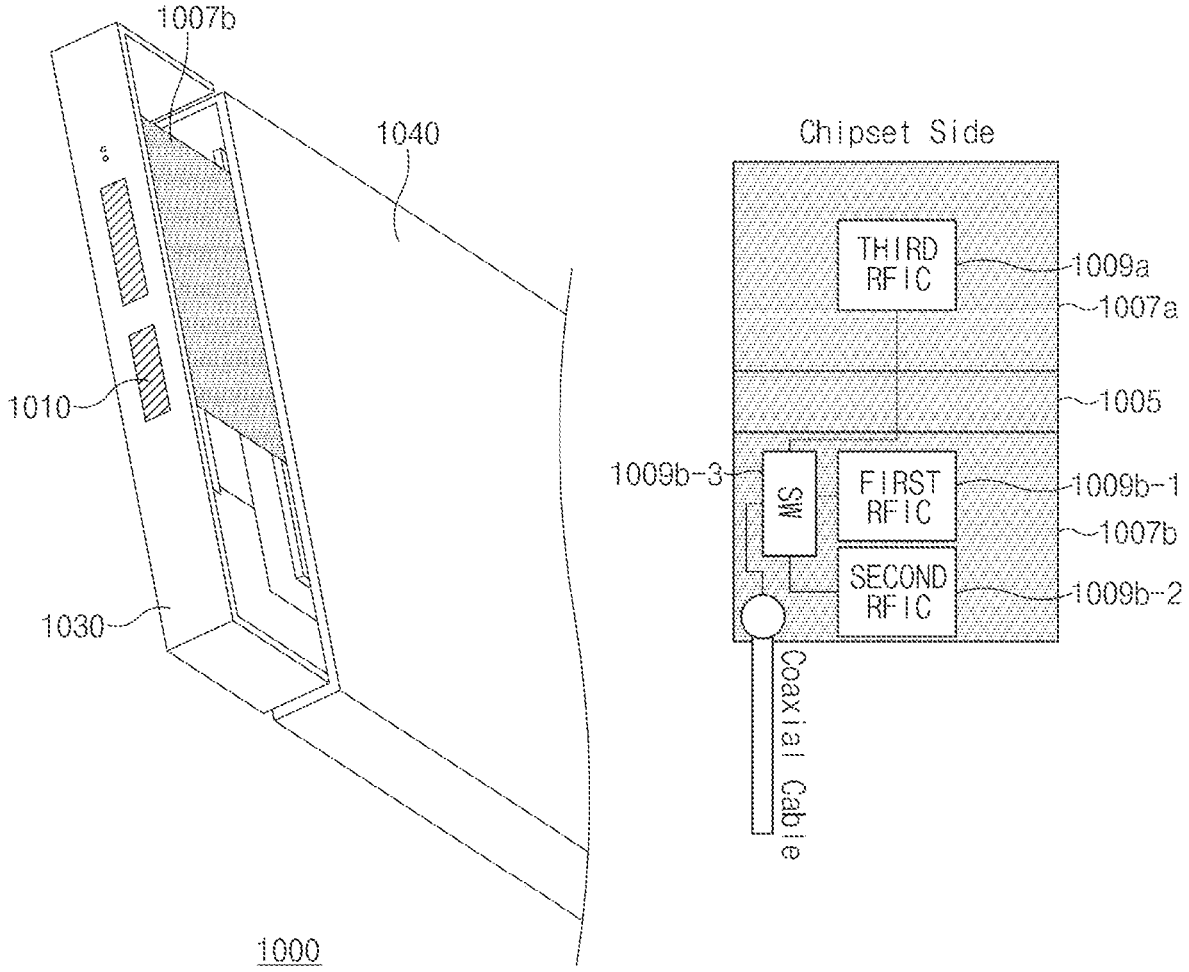
FIG. 11A is a view illustrating a mounting form of an FPCB and a PCB, according to an embodiment of the present disclosure.

FIG. 11A is a view illustrating a mounting form of an FPCB and a PCB, according to an embodiment of the present disclosure.

Referring to FIG. 11A, according to an embodiment, a FPCB 1005 (e.g., the FPCB 105 of FIG. 1 or the FPCB 1005 of FIG. 10A) accommodated inside the electronic device 1000 (e.g., the electronic device 100 of FIG. 1 or the electronic device 1000 of FIG. 10A) may be coupled to a first PCB 1007*a*, which is positioned adjacent to the inner surface of a first plate (not illustrated) (e.g., the first plate of FIG. 1), and a second PCB 1007*b*, which is positioned adjacent to the inner surface of a second plate 1040 (e.g., the second plate 140 of FIG. 1 or the second plate 1040 of FIG. 10A). For example, the first PCB or the second PCB may be a rigid printed circuit board.

According to an embodiment, the illustrated regions of the first PCB 1007*a* and the second PCB 1007*b* may correspond to the first plate and the rear surface of a surface facing the second plate 1040, respectively.

In an embodiment, in the case where an antenna element 1010 (e.g., the first antenna element 110 of FIG. 1 or the first antenna element 1010 of FIG. 10A) is formed in the side member 1030 of the electronic device 1000, an RFIC (e.g., the first RFIC of FIG. 1 or the first RFIC of FIG. 10A) for the antenna element 1010 may be disposed on the first PCB 1007*a* or the second PCB 1007*b*.

According to an embodiment, due to the high path loss of the signal of the extremely high band frequency, the antenna element may be disposed physically adjacent to the RFIC. According to an embodiment, in the case where the side member 1030 of the housing is made thin, it may be difficult to arrange the RFIC on the FPCB 1005. For example, in the case where the antenna element 1010 is formed in the side member 1030, a first RFIC 1009*b*-1 (e.g., an RFIC for the antenna element 1010 formed on the side member 1030) for the antenna element 1010 may be disposed on the first PCB 1007*a* or on the second PCB 1007*b*. The first RFIC 1009*b*-1 may be disposed adjacent to the first PCB 1007*a* or the side member 1030 of the second PCB 1007*b*, and thus the antenna element 1010 and the first RFIC 1009*b*-1 may be disposed adjacent to each other.

In another embodiment, an antenna element may be formed on the first PCB 1007*a* or the second PCB 1007*b*. For example, the antenna element may be referred to as a "slot antenna", "patch antenna", "dipole antenna", or "end fire antenna". For example, the antenna element may transmit and/or receive frequency signals between about 20 GHz and about 60 GHz. A third RFIC 1009*a* (e.g., an RFIC for an antenna element formed on the first plate) for an antenna element formed on the first PCB 1007*a* may be disposed on the first PCB 1007*a*. A second RFIC 1009*b*-2 (e.g., an RFIC for the antenna element formed on the second plate) for the antenna element formed on the second PCB 1007*b* may be disposed on the second PCB 1007*b*.

Although not illustrated in FIG. 11A, the first plate or the second plate 1040 may form an opening. The first PCB 1007*a* or second PCB 1007*b* may be disposed inside the housing such that an antenna element formed on the first PCB 1007*a* or the second PCB 1007*b* is exposed through the opening. An embodiment associated with this will be described with reference to FIG. 12.

For example, the antenna element formed on the first PCB 1007*a* or the second PCB 1007*b* may be a slot antenna. The first PCB 1007*a* or the second PCB 1007*b* may include a conductive layer that includes at least one slot extending along a conductive portion including the opening while facing the opening. A first point of a conductive layer on one side of the slot and a second point of a conductive layer on the other side of the slot may be fed by a wireless communication circuit electrically connected to the first point and the second point.

In various embodiments, an antenna element (e.g., the second antenna element 1020 of FIG. 10A) may be formed in the first plate and the second plate 1040 of the housing. For example, the third RFIC 1009*a* for the antenna element formed on the first plate may be disposed on the first PCB 1007*a*. For example, the second RFIC 1009*b*-2 for the antenna element formed on the second plate 1040 may be disposed on the second PCB 1007*b*.

In various embodiments, for the purpose of preventing the loss of the signal of the extremely high frequency band, the electronic device 1000 may switch signals to be transmitted to a plurality of RFICs 1009*a*, 1009*b*-1, and 1009*b*-2, through the switch 1009*b*-3 in the intermediate frequency band. For example, the switch 1009*b*-3 may selectively connect the intermediate frequency integrated circuit (IFIC) to a plurality of RFICs 1009*a*, 1009*b*-1, and 1009*b*-2. The IFIC may convert the signal of the intermediate frequency to a signal of a baseband or may convert a signal of the baseband to a signal of the intermediate frequency. For example, the IFIC may be disposed on the main PCB. A plurality of RFICs 1009*a*, 1009*b*-1, and 1009*b*-2 and the IFIC may be connected through, for example, a conductive line (e.g., a coaxial cable). For example, in the case where the direction in which communication is possible is the direction of the second plate 1040, the electronic device 1000 may connect the IFIC to the second RFIC 1009*b*-2 through a switch 1009*b*-3. The related description will be described later with reference to FIG. 11C.

In various embodiments, the electronic device 1000 may further include another antenna element that transmits and/or receives signals of a frequency band lower than the antenna element 1010. For example, the other antenna element may be an antenna (e.g., an antenna that performs fourth-generation mobile communication) that transmits and/or receives a frequency signal of 20 GHz or less.

The electronic device 1000 may further include a PCB (not illustrated), which is different from the first PCB 1007*a* and the second PCB 1007*b* and which is accommodated inside the housing. For example, the PCB may be the main PCB. The electronic device 1000 may further include a communication circuit, which is disposed on the PCB, for an antenna element transmitting and receiving a frequency signal of 20 GHz or less.

In various embodiments, the electronic device 1000 may simultaneously mount an antenna performing fourth-generation mobile communication and an antenna performing fifth-generation mobile communication.

FIG. 11B is a view illustrating a mounting form of an FPCB and a PCB, according to another embodiment of the present disclosure.

Referring to FIG. 11B, according to an embodiment, the FPCB 1005 (e.g., the FPCB 105 of FIG. 1 or the FPCB 1005 of FIG. 10A) accommodated inside an electronic device 1000 (e.g., the electronic device 100 of FIG. 1 or the electronic device 1000 of FIG. 10A) may be coupled to the second PCB 1007*b* positioned adjacent to the inner surface of a second plate (e.g., the second plate 140 of FIG. 1 or the second plate 1040 of FIG. 10A).

According to an embodiment, the illustrated regions of the second PCB 1007*b* may correspond to the rear surface of a surface facing the second plate 1040.

In an embodiment, in the case where the antenna element 1010 (e.g., the first antenna element 110 of FIG. 1 or the first antenna element 1010 of FIG. 10A) is formed in the side member 1030, the first RFIC 1009*b*-1 for the antenna element 1010 may be disposed on the second PCB 1007*b*. The RFIC may be disposed at the location of the second PCB 1007*b* adjacent to the side member 1030, and thus the antenna element 1010 and the first RFIC 1009*b*-1 may be disposed adjacent to each other.

In various embodiments, an antenna element (e.g., the antenna element 110 of FIG. 1) may be formed on the second PCB 1007*b*. For example, the antenna element may be referred to as a "slot antenna", "patch antenna", "dipole antenna", or "end fire antenna". The second RFIC 1009*b*-2 (e.g., RFIC Rear) for the antenna element formed on the second PCB 1007*b* may be disposed on the second PCB 1007*b*.

Although not illustrated in FIG. 11B, the second plate 1040 may include an opening. The second PCB 1007*b* may be disposed inside the housing such that an antenna element formed on the second PCB 1007*b* is exposed through the opening. An embodiment associated with this will be described with reference to FIG. 12.

In various embodiments, an antenna element (e.g., the second antenna element 1020 of FIG. 10A) may be formed in the second plate 1040. The second RFIC 1009*b*-2 for the antenna element formed on the second plate 1040 may be disposed on the second PCB 1007*b*.

Figure 11C:
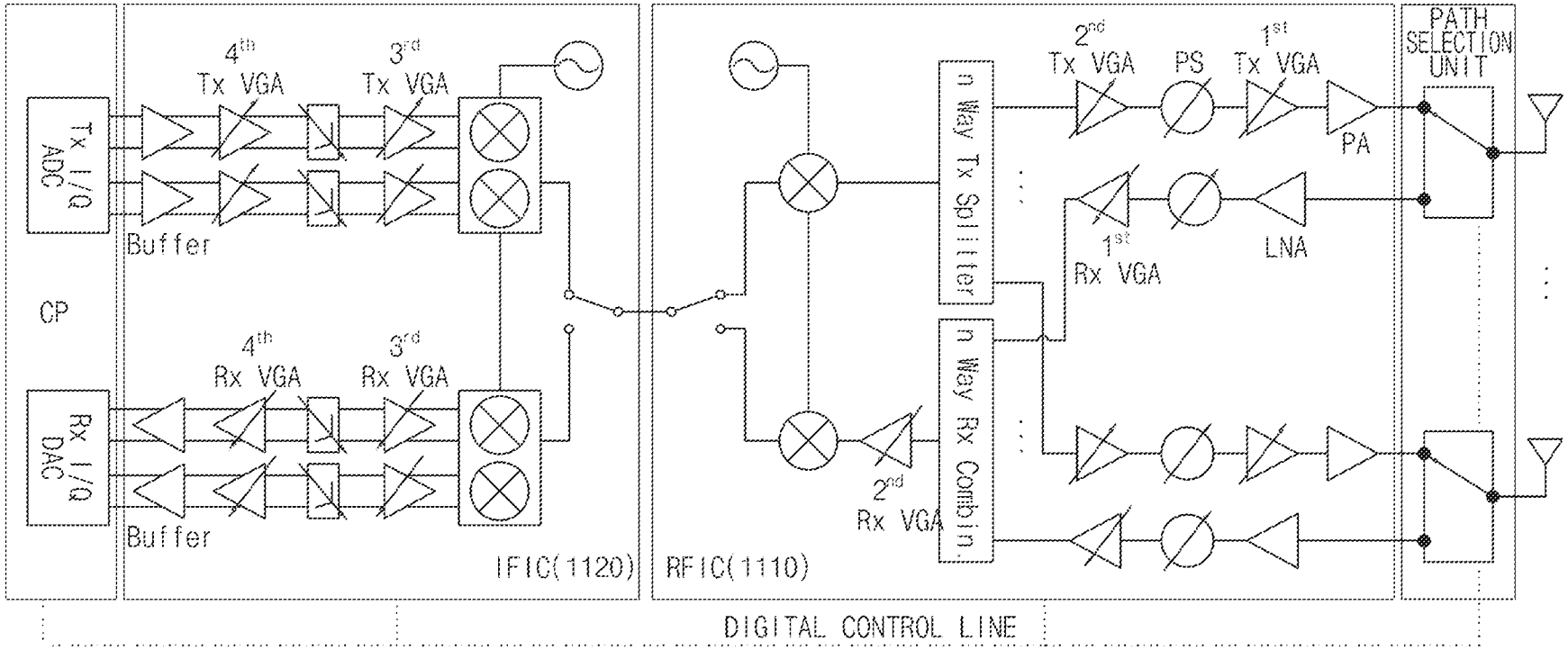
FIG. 11C is a circuit diagram of a wireless communication circuit, according to an embodiment of the present disclosure.

FIG. 11C is a circuit diagram of a wireless communication circuit, according to an embodiment of the present disclosure. Generally, a wireless communication circuit may mean an RFIC, but may broadly include an RFIC, an IFIC, and a processing circuit. The digital control line in the wireless communication circuit is omitted in FIG. 11C.

The wireless communication circuit may include, for example, a CP, an IFIC 1120, an RFIC 1110, a switch, a digital control line MIPI, I2C, PCIe, UART, USB, GPIO, or the like.

According to an embodiment, a plurality of antennas (e.g., the antenna element 110 of FIG. 1 and the antenna element 910 of FIG. 9) may be spaced apart from each other by a specific distance 'd'. An antenna may be connected to the switch. In the TDD communication, the antenna may be selectively connected to the transmitter chain Tx chain during transmission Tx or the receiver chain Rx chain during reception Rx, through the switch.

According to an embodiment, the transmitter chain of the RFIC 1110 may include a power amplifier (PA), a first variable gain amplifier (VGA), a phase shifter (PS), a second VGA, an n-way Tx splitter, and a mixer.

According to an embodiment, the PA of the RFIC 1110 may perform power amplification to the signal of the transmitter Tx. The PA may be mounted inside the RFIC 1110 or outside the RFIC 1110. Each of the VGAs may perform a TX auto gain control (AGC) operation, under control of the CP. The number of VGAs may increase or decrease if necessary. Under control of the CP, the PS may transition the phase of the signal depending on a beamforming angle. The n-way Tx Splitter may split and generate the transmitted Tx signal from the mixer, into 'n' signals. The mixer may convert up a transmission signal of an intermediate frequency from the IFIC 1120, to a transmission signal of a RF band. The mixer may receive a signal to be mixed from an internal or external oscillator.

The receiver chain of the RFIC 1110 may include a low noise amplifier (LNA), a PS, a 1st VGA, an n-Way Rx combiner, a 2nd Rx VGA, and a mixer in the RFIC 1110.

The LNA of the RFIC 1110 may perform low noise amplification on the signal received from the antenna. Each of the VGAs may perform an RX AGC operation, under control of the CP. The number of VGAs illustrated in FIG. 11C is illustrative and may be changed if necessary. Under control of the CP, the PS may transition the phase of the signal depending on the beamforming angle. The n-Way combiner may combine the signal, the phase of which is transitioned and is aligned to the same phase. The combined signal may be transmitted to the mixer via the 2nd VGA. The mixer may convert down the received signal of the RF band to a signal of an IF band. The mixer may receive a signal to be mixed from an internal or external oscillator.

According to an embodiment, the RFIC 1110 may further include a switch that selectively connects to the receiver chain or the transmitter chain of the RFIC 1110, in the next stage of the mixer. In the case where an IF frequency is high, it is difficult to connect to the transmission line between the RFIC 1110 and the IFIC 1120. When the receiver chain or the transmitter chain is selectively connected by using the switch upon operating TDD, the number of transmission lines between the RFIC 1110 and the IFIC 1120 may be reduced.

According to an embodiment, like the RFIC 1110, the IFIC 1120 may further include a switch that selectively connects to the receiver chain or the transmitter chain of the IFIC 1120.

According to an embodiment, for example, the transmitter chain of the IFIC 1120 may include a quadrature Mixer, a $3^{rd}$ Tx VGA, a low pass filter (LPF), a $4^{th}$ TxVGA, and a buffer. When receiving the balanced Tx I/Q signal from the CP, the buffer may serve as a buffer, and thus the signal may be stably processed. The $3^{rd}$ Tx VGA and the $4^{th}$ Tx VGA may serve as a transmitter AGC, under control of the CP. The LPF may serve a channel filter by setting the bandwidth of the Tx I/Q signal of a base band to a cutoff frequency bandwidth. It is possible to change the cutoff frequency. The quadrature mixer may serve an up-converter that converts up the balanced Tx I/Q signal to a Tx-IF signal.

According to an embodiment, the receiver chain of the IFIC 1120 may include a quadrature Mixer, a 3rd VGA, a LPF, a $4^{th}$ VGA, and a buffer. When transmitting an I/Q signal balanced through the $4^{th}$ VGA to the CP, the buffer may serve as a buffer, and thus the signal may be stably processed. Each of the $3^{rd}$ Rx VGA and the $4^{th}$ Rx VGA may serve as a receiver AGC, under control of the CP. The LPF may serve a channel filter by setting the bandwidth of the balanced Rx I/Q signal of a base band to the cutoff frequency bandwidth. It is possible to change the cutoff frequency. The quadrature mixer may perform down-conversion on an Rx-IF signal to generate the balanced Rx I/Q signal.

According to an embodiment, a Tx I/Q DAC in the CP may convert a digital signal, which is modulated by a MODEM, to the balanced Tx I/Q signal to transmit the balanced Tx I/Q signal to the IFIC 1120. An Rx I/Q ADC in the CP may convert the balanced Rx I/Q signal, which is converted down by the IFIC 1120, to a digital signal to transmit the digital signal to the MODEM.

Figure 12:
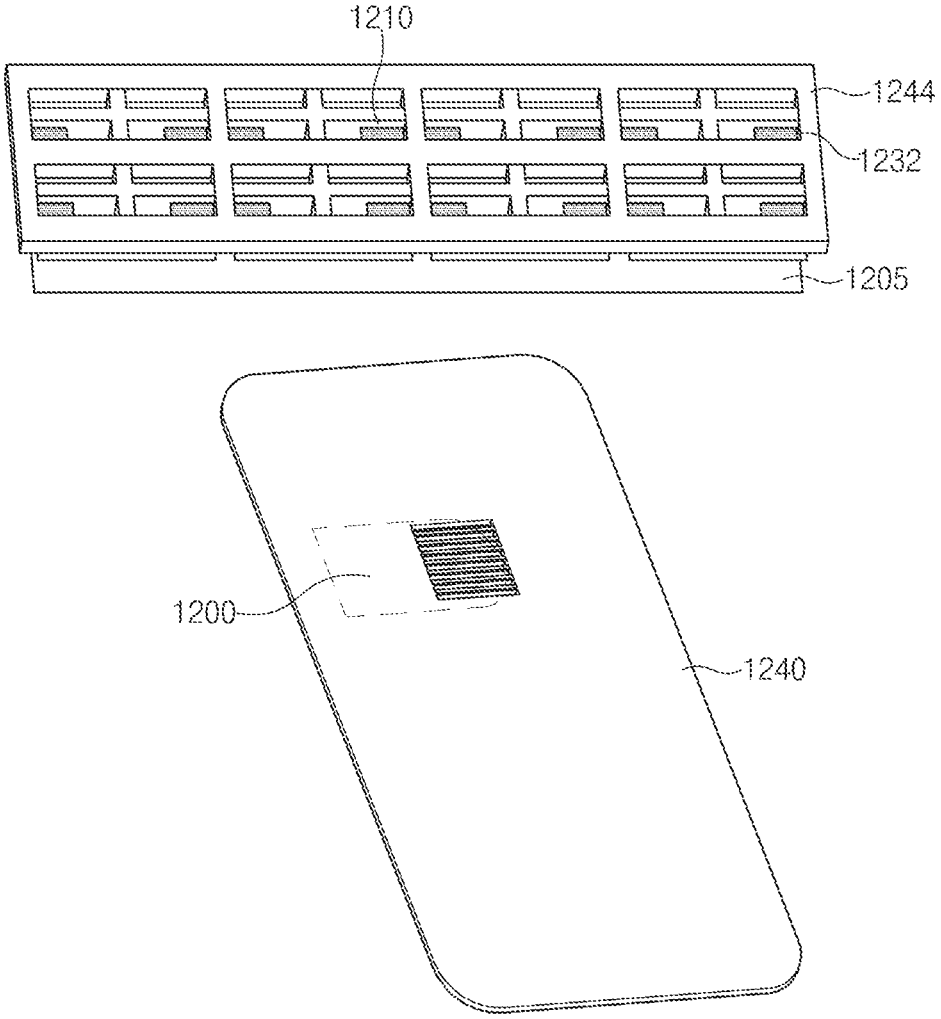
FIG. 12 is a perspective view of an electronic device in which a cooler is mounted, according to an embodiment of the present disclosure.

FIG. 12 is a perspective view of an electronic device in which a cooler is mounted, according to an embodiment of the present disclosure.

Referring to FIG. 12, according to an embodiment, an electronic device (e.g., the electronic device 100 of FIG. 1) may further include a cooler 1200 accommodated inside a housing.

In an embodiment, an opening 1232 (e.g., an opening formed in the second plate 1040 of FIG. 11A or 11B) may be formed in the second plate 1240 of the housing (e.g., the second plate 140 of FIG. 1).

In an embodiment, the second PCB 1205 may include an antenna element 1210. For example, the antenna element 1210 may be referred to as a "slot antenna", "patch antenna", "dipole antenna", or "end fire antenna". For example, the second PCB 1205 may be positioned adjacent to the inner surface of the second plate 1240.

In an embodiment, the cooler 1200 may be interposed between a first plate (e.g., the first plate of FIG. 1) and the second PCB 1205 facing the opening 1232.

In an embodiment, the second PCB 1205 may include a plurality of holes (e.g., similar to the plurality of holes 650 in FIG. 6). The plurality of holes may be positioned to face the opening 1232. The plurality of holes may allow air to flow to the inside of the housing. An RFIC (e.g., RFIC Rear in FIG. 11A or 11B) mounted on the antenna element 1210 and the second PCB 1205 may be directly cooled by the air flow according to the operation of the cooler 1200.

Figure 13A:
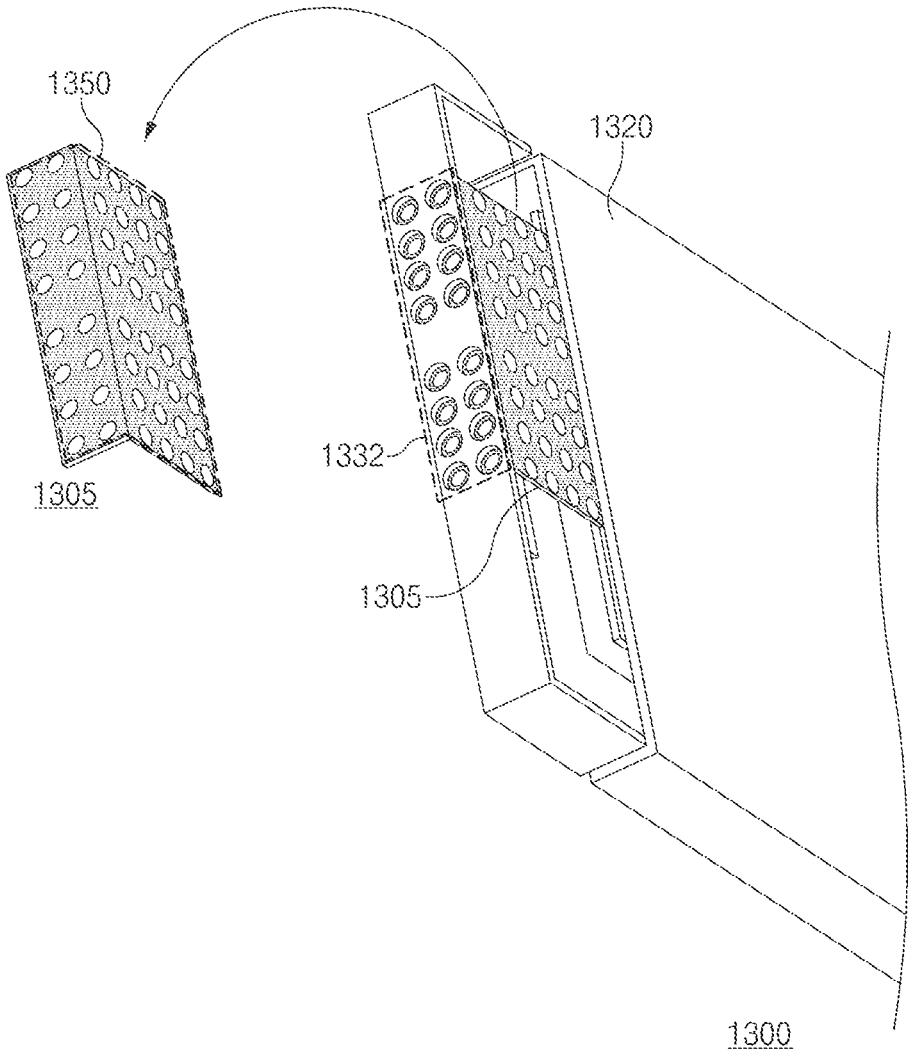
FIGS. 13A and 13B are perspective views of an electronic device including a patch antenna, according to an embodiment of the present disclosure.
Figure 13B:
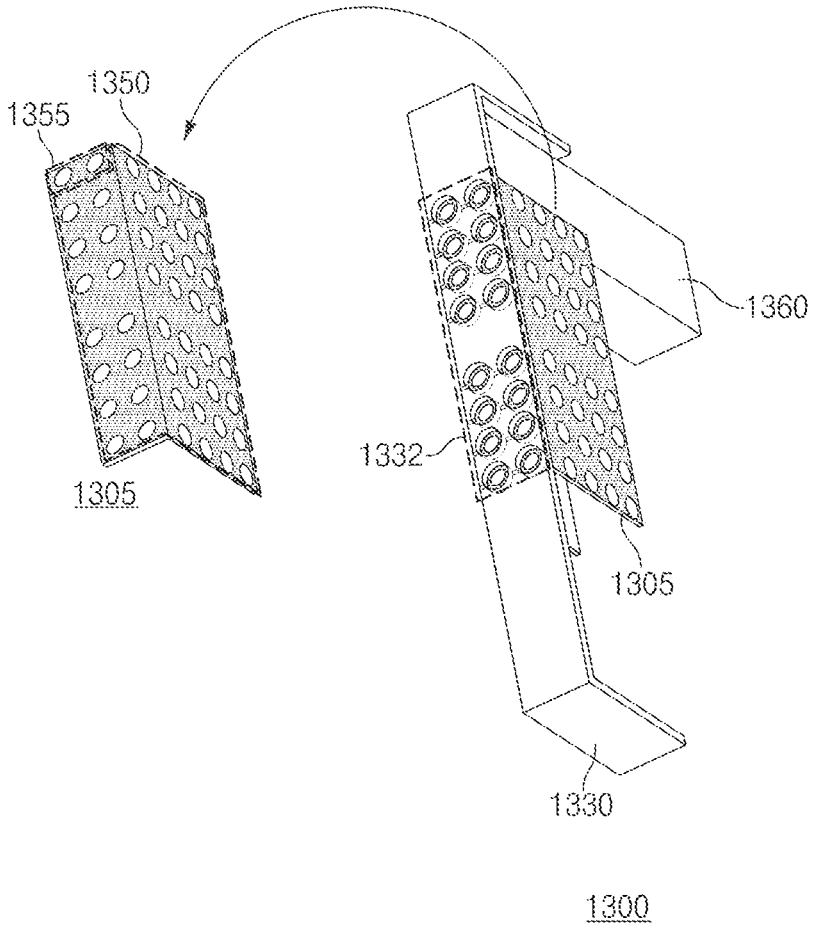

FIGS. 13A and 13B are perspective views of an electronic device including a patch antenna, according to an embodiment of the present disclosure.

Referring to FIG. 13A, an electronic device 1300 (e.g., the electronic device 100 of FIG. 1) according to an embodiment may include a plurality of patch antennas. For example, a plurality of conductive regions included in a FPCB 1305 may form a plurality of patch antennas 1350. The plurality of conductive regions may be referred to as a "region" where a portion of the FPCB 130 is filled with conductive material.

In an embodiment, a plurality of openings 1332 may be formed in the housing of the electronic device 1300. The FPCB 1305 may be disposed on the inner surface of the housing such that the plurality of patch antennas are exposed to the outside through the plurality of openings 1332. Signals of the plurality of patch antennas may be radiated through the plurality of openings 1332. For example, the plurality of openings 1332 may be formed to be similar to a plurality of patch antennas 1350.

In an embodiment, the electronic device 1300 may include an RFIC for the plurality of patch antennas 1350. For example, a feeding circuit included in the RFIC may feed each of the plurality of conductive regions, and thus the fed conductive regions may operate as the plurality of patch antennas 1350. For example, the RFIC may be disposed on a PCB (e.g., the second PCB 1007*b* of FIGS. 11A and 11B) disposed on the inner surface of the first plate (e.g., the first plate of FIG. 1) or the second plate 1320 (e.g., the second plate 140 of FIG. 1).

Referring to FIG. 13B, in an embodiment, the electronic device 1300 may further include a speaker 1360 (e.g., the speaker 800 of FIG. 8 or a speaker module) accommodated inside the housing. The speaker 1360 may serve to support the FPCB 1305. For example, the FPCB 1305 may be attached to the enclosure of the speaker 1360.

In an embodiment, the FPCB 1305 may include a plurality of through-holes 1355 (e.g., the plurality of holes 650) for outputting a sound signal generated by the speaker 1360, to the outside of the housing. The plurality of through-holes 1355 may be formed to be the same as or similar to a plurality of patch antennas 1350.

According to an embodiment of the present disclosure, an electronic device may include a housing including a first plate, a second plate opposite to the first plate, and a side member surrounding a space between the first plate and the second plate, and including at least part of a conductive material, a flexible printed circuit board (FPCB) attached on an inner surface of the housing, a first antenna element which is included in the FPCB and in which a slot is formed, and a first radio frequency integrated circuit (RFIC) for the first antenna element. An opening may be formed in the side member or the second plate of the housing. The FPCB may be attached the inner surface of the housing such that at least part in which the slot of the first antenna element is formed is exposed through the opening. At least part of the opening may be filled with an insulating material. The insulating material may contact the at least part in which the slot of the first antenna element is formed.

According to an embodiment of the present disclosure, the electronic device may further include a printed circuit board (PCB) accommodated inside the housing, a second antenna element configured to transmit and/or receive a signal of a frequency band lower than the first antenna element, and a second RFIC, which is disposed in the PCB, for the second antenna element.

According to an embodiment of the present disclosure, the FPCB may be coupled to a first PCB positioned adjacent to an inner surface of the first plate or a second PCB positioned adjacent to an inner surface of the second plate.

According to an embodiment of the present disclosure, the first RFIC may be disposed in the first PCB or the second PCB.

According to an embodiment of the present disclosure, the electronic device may further include an antenna reflector accommodated inside the housing and the first antenna element may be interposed between the opening and the antenna reflector.

According to an embodiment of the present disclosure, the electronic device may further include a speaker accommodated inside the housing. The antenna reflector may be attached to an enclosure of the speaker.

According to an embodiment of the present disclosure, the FPCB may include a plurality of holes, and the FPCB may be attached to the inner surface of the housing such that the plurality of holes are positioned to face the opening.

According to an embodiment of the present disclosure, the electronic device may further include a speaker accommodated inside the housing. The speaker may be disposed on a surface opposite to a surface of the FPCB facing the opening.

According to an embodiment of the present disclosure, the opening may be formed in the side member. The second plate may include the opening and another opening. The second PCB may include a second antenna element having one or more conductive patterns, and the second PCB may be positioned such that at least part of the second antenna element is exposed through the another opening.

According to an embodiment of the present disclosure, the electronic device may further include a cooler accommodated inside the housing. The cooler may be interposed between the first plate and the second PCB facing the other opening.

According to an embodiment of the present disclosure, an electronic device may include a housing including a first plate, a second plate opposite to the first plate, and a side member surrounding a space between the first plate and the second plate, and including a conductive material, a first antenna element included in the side member, an FPCB attached to an inner surface of the housing, and a RFIC for the first antenna element. An opening may be formed in the first antenna element. The opening may be filled with an insulating material, and the first RFIC may feed the opening.

According to an embodiment of the present disclosure, an area of the opening of the inner surface of the housing may be smaller than an area of the opening of an outer surface of the housing.

According to an embodiment of the present disclosure, the insulating material may include a metal oxide filling an outer portion of the housing and an insulating material, different from the metal oxide, filling the inner portion of the housing.

According to an embodiment of the present disclosure, the FPCB may be coupled to a first PCB positioned adjacent to an inner surface of the first plate or a second PCB positioned adjacent to an inner surface of the second plate.

According to an embodiment of the present disclosure, the first RFIC may be disposed in the first PCB or the second PCB.

According to an embodiment of the present disclosure, the electronic device may further include a PCB accommodated inside the housing, a second antenna element transmitting and/or receiving a signal of a frequency band lower than the first antenna element, and a second RFIC, which is disposed in the PCB, for the second antenna element.

According to an embodiment of the present disclosure, an electronic device may include a housing including a front plate, a back plate facing away from the front plate, and a side member surrounding a space between the front plate and the back plate. The side member may include a conductive portion including at least one opening formed therethrough, and a non-conductive material filling at least part of the at least one opening, a housing, a touchscreen display exposed through the front plate, a FPCB positioned inside the space near the at least one opening, a first wireless communication circuit electrically connected to a first point of the first conductive layer on one side of the first slot, and a second point of the first conductive layer on the other side of the first slot, and a processor electrically connected to the touchscreen display and the first wireless communication circuit. The FPCB may include a first conductive layer including at least one first slot extending along the conductive portion, while facing the opening. The first wireless communication circuit may be configured to transmit and/or receive a signal in a range between 20 GHz and 40 GHz.

According to an embodiment of the present disclosure, an electronic device may further include at least one speaker module positioned inside the space such that the first conductive layer is interposed between the speaker module and the side member. The first conductive layer may further includes a plurality of through-holes near the at least one first slot.

According to an embodiment of the present disclosure, the non-conductive material and the conductive portion together may form at least one gap that serves as a sound conduit for the speaker module.

According to an embodiment of the present disclosure, the second plate may include the conductive portion including at least one second opening. The electronic device may further include a PCB positioned adjacent to the at least one second opening inside the space and a second wireless communication circuit electrically connected to a first point of the second conductive layer on one side of the second slot, and a second point of the second conductive layer on the other side of the second slot. The PCB may include a second conductive layer including at least one second slot extending along the conductive portion including the at least one second opening while facing the second opening. The FPCB may be coupled to the PCB, and the first wireless communication circuit and the second wireless communication circuit may be disposed on the PCB.

Figure 14:
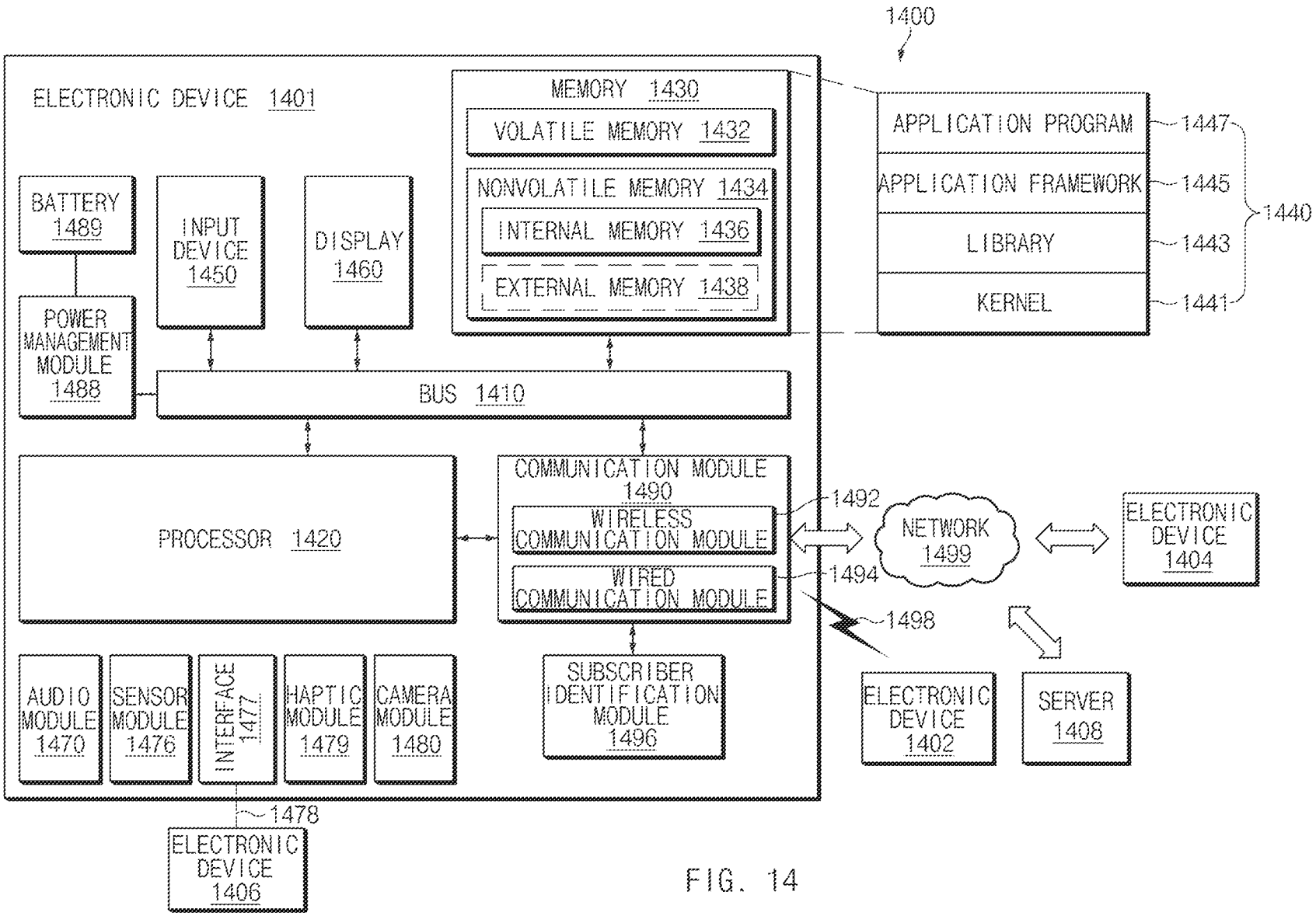
FIG. 14 illustrates an electronic device in a network environment, according to various embodiments.

FIG. 14 illustrates an electronic device 1401 in a network environment 1400, according to various embodiments. An electronic device according to various embodiments of this disclosure may include various forms of devices. For example, the electronic device may include at least one of, for example, portable communication devices (e.g., smartphones), computer devices (e.g., personal digital assistants (PDAs), tablet personal computers (PCs), laptop PCs, desktop PCs, workstations, or servers), portable multimedia devices (e.g., electronic book readers or Motion Picture Experts Group (MPEG-1 or MPEG-2) Audio Layer 3 (MP3) players), portable medical devices (e.g., heartbeat measuring devices, blood glucose monitoring devices, blood pressure measuring devices, and body temperature measuring devices), cameras, or wearable devices. The wearable device may include at least one of an accessory type (e.g., watches, rings, bracelets, anklets, necklaces, glasses, contact lens, or head-mounted-devices (HMDs)), a fabric or garment-integrated type (e.g., an electronic apparel), a body-attached type (e.g., a skin pad or tattoos), or a bio-implantable type (e.g., an implantable circuit). According to various embodiments, the electronic device may include at least one of, for example, televisions (TVs), digital versatile disk (DVD) players, audios, audio accessory devices (e.g., speakers, headphones, or headsets), refrigerators, air conditioners, cleaners, ovens, microwave ovens, washing machines, air cleaners, set-top boxes, home automation control panels, security control panels, game consoles, electronic dictionaries, electronic keys, camcorders, or electronic picture frames.

In another embodiment, the electronic device may include at least one of navigation devices, satellite navigation system (e.g., Global Navigation Satellite System (GNSS)), event data recorders (EDRs) (e.g., black box for a car, a ship, or a plane), vehicle infotainment devices (e.g., head-up display for vehicle), industrial or home robots, drones, automatic teller's machines (ATMs), points of sales (POSs), measuring instruments (e.g., water meters, electricity meters, or gas meters), or internet of things (e.g., light bulbs, sprinkler devices, fire alarms, thermostats, or street lamps). The electronic device according to an embodiment of this disclosure may not be limited to the above-described devices, and may provide functions of a plurality of devices like smartphones which has measurement function of personal biometric information (e.g., heart rate or blood glucose). In this disclosure, the term "user" may refer to a person who uses an electronic device or may refer to a device (e.g., an artificial intelligence electronic device) that uses the electronic device.

Referring to FIG. 14, under the network environment 1400, the electronic device 1401 (e.g., the electronic device 100 of FIG. 1 or the electronic device 900 of FIG. 9) may communicate with an electronic device 1402 through local wireless communication 1498 or may communication with an electronic device 1404 or a server 1408 through a network 1499. According to an embodiment, the electronic device 1401 may communicate with the electronic device 1404 through the server 1408.

According to an embodiment, the electronic device 1401 may include a bus 1410, a processor 1420, a memory 1430, an input device 1450 (e.g., a micro-phone or a mouse), a display device 1460, an audio module 1470, a sensor module

1476, an interface 1477, a haptic module 1479, a camera module 1480, a power management module 1488, a battery 1489, a communication module 1490, and a subscriber identification module 1496. According to an embodiment, the electronic device 1401 may not include at least one (e.g., the display device 1460 or the camera module 1480) of the above-described elements or may further include other element(s).

The bus 1410 may interconnect the above-described elements 1420 to 1490 and may include a circuit for conveying signals (e.g., a control message or data) between the above-described elements.

The processor 1420 may include one or more of a central processing unit (CPU), an application processor (AP), a graphic processing unit (GPU), an image signal processor (ISP) of a camera or a communication processor (CP). According to an embodiment, the processor 1420 may be implemented with a system on chip (SoC) or a system in package (SiP). For example, the processor 1420 may drive an operating system (OS) or an application to control another element (e.g., hardware or software element) connected to the processor 1420 and may process and compute various data. The processor 1420 may load a command or data, which is received from at least one of other elements (e.g., the communication module 1490), into a volatile memory 1432 to process the command or data and may store the result data into a nonvolatile memory 1434.

The memory 1430 may include, for example, the volatile memory 1432 or the nonvolatile memory 1434. The volatile memory 1432 may include, for example, a random access memory (RAM) (e.g., a dynamic RAM (DRAM), a static RAM (SRAM), or a synchronous DRAM (SDRAM)). The nonvolatile memory 1434 may include, for example, a programmable read-only memory (PROM), an one time PROM (OTPROM), an erasable PROM (EPROM), an electrically EPROM (EEPROM), a mask ROM, a flash ROM, a flash memory, a hard disk drive (HDD), or a solid-state drive (SSD). In addition, the nonvolatile memory 1434 may be configured in the form of an internal memory 1436 or the form of an external memory 1438 which is available through connection only if necessary, according to the connection with the electronic device 1401. The external memory 1438 may further include a flash drive such as compact flash (CF), secure digital (SD), micro secure digital (Micro-SD), mini secure digital (Mini-SD), extreme digital (xD), a multimedia card (MMC), or a memory stick. The external memory 1438 may be operatively or physically connected with the electronic device 1401 in a wired manner (e.g., a cable or a universal serial bus (USB)) or a wireless (e.g., Bluetooth) manner.

For example, the memory 1430 may store, for example, a different software element, such as a command or data associated with the program 1440, of the electronic device 1401. The program 1440 may include, for example, a kernel 1441, a library 1443, an application framework 1445 or an application program (interchangeably, "application") 1447.

The input device 1450 may include a microphone, a mouse, or a keyboard. According to an embodiment, the keyboard may include a keyboard physically connected or a virtual keyboard displayed through the display 1460.

The display 1460 may include a display, a hologram device or a projector, and a control circuit to control a relevant device. The display may include, for example, a liquid crystal display (LCD), a light emitting diode (LED) display, an organic LED (OLED) display, a microelectromechanical systems (MEMS) display, or an electronic paper display. According to an embodiment, the display may be flexibly, transparently, or wearably implemented. The display may include a touch circuitry, which is able to detect a user's input such as a gesture input, a proximity input, or a hovering input or a pressure sensor (interchangeably, a force sensor) which is able to measure the intensity of the pressure by the touch. The touch circuit or the pressure sensor may be implemented integrally with the display or may be implemented with at least one sensor separately from the display. The hologram device may show a stereoscopic image in a space using interference of light. The projector may project light onto a screen to display an image. The screen may be located inside or outside the electronic device 1401.

The audio module 1470 may convert, for example, from a sound into an electrical signal or from an electrical signal into the sound. According to an embodiment, the audio module 1470 may acquire sound through the input device 1450 (e.g., a microphone) or may output sound through an output device (not illustrated) (e.g., a speaker or a receiver) included in the electronic device 1401, an external electronic device (e.g., the electronic device 1402 (e.g., a wireless speaker or a wireless headphone)) or an electronic device 1406 (e.g., a wired speaker or a wired headphone) connected with the electronic device 1401

The sensor module 1476 may measure or detect, for example, an internal operating state (e.g., power or temperature) of the electronic device 1401 or an external environment state (e.g., an altitude, a humidity, or brightness) to generate an electrical signal or a data value corresponding to the information of the measured state or the detected state. The sensor module 1476 may include, for example, at least one of a gesture sensor, a gyro sensor, a barometric pressure sensor, a magnetic sensor, an acceleration sensor, a grip sensor, a proximity sensor, a color sensor (e.g., a red, green, blue (RGB) sensor), an infrared sensor, a biometric sensor (e.g., an iris sensor, a fingerprint senor, a heartbeat rate monitoring (HRM) sensor, an e-nose sensor, an electromyography (EMG) sensor, an electroencephalogram (EEG) sensor, an electrocardiogram (ECG) sensor), a temperature sensor, a humidity sensor, an illuminance sensor, or an UV sensor. The sensor module 1476 may further include a control circuit for controlling at least one or more sensors included therein. According to an embodiment, the sensor module 1476 may be controlled by using the processor 1420 or a processor (e.g., a sensor hub) separate from the processor 1420. In the case that the separate processor (e.g., a sensor hub) is used, while the processor 1420 is in a sleep state, the separate processor may operate without awakening the processor 1420 to control at least a portion of the operation or the state of the sensor module 1476.

According to an embodiment, the interface 1477 may include a high definition multimedia interface (HDMI), a universal serial bus (USB), an optical interface, a recommended standard 232 (RS-232), a D-subminiature (D-sub), a mobile high-definition link (MHL) interface, a SD card/MMC (multi-media card) interface, or an audio interface. A connector 1478 may physically connect the electronic device 1401 and the electronic device 1406. According to an embodiment, the connector 1478 may include, for example, an USB connector, an SD card/MMC connector, or an audio connector (e.g., a headphone connector).

The haptic module 1479 may convert an electrical signal into mechanical stimulation (e.g., vibration or motion) or into electrical stimulation. For example, the haptic module 1479 may apply tactile or kinesthetic stimulation to a user. The haptic module 1479 may include, for example, a motor, a piezoelectric element, or an electric stimulator.

The camera module 1480 may capture, for example, a still image and a moving picture. According to an embodiment, the camera module 1480 may include at least one lens (e.g., a wide-angle lens and a telephoto lens, or a front lens and a rear lens), an image sensor, an image signal processor, or a flash (e.g., a light emitting diode or a xenon lamp).

The power management module 1488, which is to manage the power of the electronic device 1401, may constitute at least a portion of a power management integrated circuit (PMIC).

The battery 1489 may include a primary cell, a secondary cell, or a fuel cell and may be recharged by an external power source to supply power an element of the electronic device 1401.

The communication module 1490 may establish a communication channel between the electronic device 1401 and an external device (e.g., the first external electronic device 1402, the second external electronic device 1404, or the server 1408). The communication module 1490 may support wired communication or wireless communication through the established communication channel. According to an embodiment, the communication module 1490 may include a wireless communication module 1492 or a wired communication module 1494. The communication module 1490 may communicate with the external device through a first network 1498 (e.g. a wireless local area network such as Bluetooth or infrared data association (IrDA)) or a second network 1499 (e.g., a wireless wide area network such as a cellular network) through a relevant module among the wireless communication module 1492 or the wired communication module 1494.

The wireless communication module 1492 may support, for example, cellular communication, local wireless communication, global navigation satellite system (GNSS) communication. The cellular communication may include, for example, long-term evolution (LTE), LTE Advance (LTE-A), code division multiple access (CMA), wideband CDMA (WCDMA), universal mobile telecommunications system (UMTS), wireless broadband (WiBro), or global system for mobile communications (GSM). The local wireless communication may include wireless fidelity (Wi-Fi), WiFi Direct, light fidelity (Li-Fi), Bluetooth, Bluetooth low energy (BLE), Zigbee, near field communication (NFC), magnetic secure transmission (MST), radio frequency (RF), or a body area network (BAN). The GNSS may include at least one of a global positioning system (GPS), a global navigation satellite system (Glonass), Beidou Navigation Satellite System (Beidou), the European global satellite-based navigation system (Galileo), or the like. In the present disclosure, "GPS" and "GNSS" may be interchangeably used.

According to an embodiment, when the wireless communication module 1492 supports cellar communication, the wireless communication module 1492 may, for example, identify or authenticate the electronic device 1401 within a communication network using the subscriber identification module (e.g., a SIM card) 1496. According to an embodiment, the wireless communication module 1492 may include a communication processor (CP) separate from the processor 1420 (e.g., an application processor (AP)). In this case, the communication processor may perform at least a portion of functions associated with an element 1410 to 1496 of the electronic device 1401 in substitute for the processor 1420 when the processor 1420 is in an inactive (sleep) state, and together with the processor 1420 when the processor 1420 is in an active state. According to an embodiment, the wireless communication module 1492 may include a plurality of communication modules, each supporting only a relevant communication scheme among cellular communication, local wireless communication, or a GNSS communication.

The wired communication module 1494 may include, for example, include a local area network (LAN) service, a power line communication, or a plain old telephone service (POTS).

For example, the first network 1498 may employ, for example, Wi-Fi direct or Bluetooth for transmitting or receiving commands or data through wireless direct connection between the electronic device 1401 and the first external electronic device 1402. The second network 1499 may include a telecommunication network (e.g., a computer network such as a LAN or a WAN, the Internet or a telephone network) for transmitting or receiving commands or data between the electronic device 1401 and the second electronic device 1404.

According to various embodiments, the commands or the data may be transmitted or received between the electronic device 1401 and the second external electronic device 1404 through the server 1408 connected with the second network 1499. Each of the first and second external electronic devices 1402 and 1404 may be a device of which the type is different from or the same as that of the electronic device 1401. According to various embodiments, all or a part of operations that the electronic device 1401 will perform may be executed by another or a plurality of electronic devices (e.g., the electronic devices 1402 and 1404 or the server 1408). According to an embodiment, in the case that the electronic device 1401 executes any function or service automatically or in response to a request, the electronic device 1401 may not perform the function or the service internally, but may alternatively or additionally transmit requests for at least a part of a function associated with the electronic device 1401 to any other device (e.g., the electronic device 1402 or 1404 or the server 1408). The other electronic device (e.g., the electronic device 1402 or 1404 or the server 1408) may execute the requested function or additional function and may transmit the execution result to the electronic device 1401. The electronic device 1401 may provide the requested function or service using the received result or may additionally process the received result to provide the requested function or service. To this end, for example, cloud computing, distributed computing, or client-server computing may be used.

Various embodiments of the present disclosure and terms used herein are not intended to limit the technologies described in the present disclosure to specific embodiments, and it should be understood that the embodiments and the terms include modification, equivalent, and/or alternative on the corresponding embodiments described herein. With regard to description of drawings, similar elements may be marked by similar reference numerals. The terms of a singular form may include plural forms unless otherwise specified. In the disclosure disclosed herein, the expressions "A or B", "at least one of A and/or B", "at least one of A and/or B", "A, B, or C", or "at least one of A, B, and/or C", and the like used herein may include any and all combinations of one or more of the associated listed items. Expressions such as "first," or "second," and the like, may express their elements regardless of their priority or importance and may be used to distinguish one element from another element but is not limited to these components. When an (e.g., first) element is referred to as being "(operatively or communicatively) coupled with/to" or "connected to" another (e.g., second) element, it may be directly coupled with/to or connected to the other element or an intervening element (e.g., a third element) may be present.

According to the situation, the expression "adapted to or configured to" used herein may be interchangeably used as, for example, the expression "suitable for", "having the capacity to", "changed to", "made to", "capable of" or "designed to" in hardware or software. The expression "a device configured to" may mean that the device is "capable of" operating together with another device or other components. For example, a "processor configured to (or set to) perform A, B, and C" may mean a dedicated processor (e.g., an embedded processor) for performing corresponding operations or a generic-purpose processor (e.g., a central processing unit (CPU) or an application processor) which performs corresponding operations by executing one or more software programs which are stored in a memory device (e.g., the memory 1430).

The term "module" used herein may include a unit, which is implemented with hardware, software, or firmware, and may be interchangeably used with the terms "logic", "logical block", "component", "circuit", or the like. The "module" may be a minimum unit of an integrated component or a part thereof or may be a minimum unit for performing one or more functions or a part thereof. The "module" may be implemented mechanically or electronically and may include, for example, an application-specific IC (ASIC) chip, a field-programmable gate array (FPGA), and a programmable-logic device for performing some operations, which are known or will be developed.

According to various embodiments, at least a part of an apparatus (e.g., modules or functions thereof) or a method (e.g., operations) may be, for example, implemented by instructions stored in a computer-readable storage media (e.g., the memory 1430) in the form of a program module. The instruction, when executed by a processor (e.g., a processor 1420), may cause the processor to perform a function corresponding to the instruction. The computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), an embedded memory, and the like. The one or more instructions may contain a code made by a compiler or a code executable by an interpreter.

Each element (e.g., a module or a program module) according to various embodiments may be composed of single entity or a plurality of entities, a part of the above-described sub-elements may be omitted or may further include other sub-elements. Alternatively or additionally, after being integrated in one entity, some elements (e.g., a module or a program module) may identically or similarly perform the function executed by each corresponding element before integration. According to various embodiments, operations executed by modules, program modules, or other elements may be executed by a successive method, a parallel method, a repeated method, or a heuristic method, or at least one part of operations may be executed in different sequences or omitted. Alternatively, other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A portable communication device comprising:

a housing including a front plate, a rear plate, and a side member substantially surrounding a space between the front plate and the rear plate, the side member including a conductive portion including a first opening and a second opening formed therein, and a non-conductive portion at least partially located in the first opening and the second opening, each of the first opening and the second opening formed between an inner surface and an outer surface of the conductive portion; and a plurality of antenna modules accommodated in the housing, the plurality of antenna modules including:

a first antenna module facing in a first direction toward the front plate and including a first antenna array to be used for forming a first beam;

a second antenna module facing in a second direction different from the first direction, the second antenna module including:

a second antenna array to be used for forming a second beam, the second antenna array including a first conductive pattern and supporting a first mmWave frequency band; and a third antenna array to be used for forming a third beam, the third antenna array including a second conductive pattern at least partially spaced apart from the first conductive pattern and supporting a second mmWave frequency band; and a third antenna module facing in a third direction different from the first direction and the second direction, and including a fourth antenna array to be used for forming a fourth beam, the fourth antenna array including a first antenna element located at a first area corresponding to the first opening, and a second antenna element located at a second area corresponding to the second opening.

2. The portable communication device of claim 1, further comprising:

a first radio frequency integrated circuit (RFIC) electrically connected with the second antenna array and the third antenna array;

a second RFIC electrically connected with the fourth antenna array; and an intermediate frequency integrated circuit (IFIC) selectively connected with the first RFIC or the second RFIC via a switching circuit.

3. The portable communication device of claim 2, wherein the second antenna module includes a first surface facing the front plate and a second surface facing the rear plate, wherein the second antenna array and the third antenna array are disposed on the second surface, and wherein the first RFIC is disposed on the first surface.

4. The portable communication device of claim 1, wherein the first antenna array is to configured to radiate the first beam substantially in the first direction, wherein the second antenna array and third antenna array are configured to radiate the second beam corresponding to the first mmWave frequency band and the third beam corresponding to the second mmWave frequency band, respectively, substantially in the second direction, and wherein the fourth antenna array is configured to radiate the fourth beam substantially in the third direction.

5. The portable communication device of claim 1, wherein each of the first antenna array and the fourth antenna array is configured to support the first mmWave frequency band and/or the second mmWave frequency band.

6. The portable communication device of claim 1, wherein at least one portion of the conductive portion included in the side member is configured to operate as at least part of an antenna.

7. The portable communication device of claim 6, wherein the side member includes a first slit and a second slit formed at a first ending portion and a second ending portion of the at least one portion of the conductive portion.

8. The portable communication device of claim 1, wherein each of the first opening and the second opening is disposed at an upper side having a length shorter than that of a right side of the portable communication device.

9. The portable communication device of claim 1, wherein the second antenna module is disposed to face the rear plate.

10. The portable communication device of claim 1, wherein the third antenna module is disposed to face the side member.

11. A portable communication device comprising:

a housing including a side member forming a side surface of the portable communication device, the side member including a conductive member including a first opening and a second opening formed therein, and a non-conductive member at least partially located in at least one of the first opening or the second opening;

a first antenna module accommodated in the housing to face in a first direction toward a front surface of the portable communication device, the first antenna module including a first antenna array formed therein and configured to radiate a first beam substantially toward the front surface;

a second antenna module accommodated in the housing to face in a second direction different from the first direction, the second antenna module including a second antenna array and a third antenna array formed therein, the second antenna array configured to radiate a second beam corresponding to a first mmWave frequency band, and the third antenna array spaced apart from the second antenna array and configured to radiate a third beam corresponding to a second mmWave frequency band; and a third antenna module accommodated in the housing to face in a third direction different from the first direction and the second direction, the third antenna module including a fourth antenna array formed therein and configured to radiate a fourth beam, the fourth antenna array including a first antenna element located as at least partially aligned with the first opening and a second antenna element located as at least partially aligned with the second opening.

12. The portable communication device of claim 11, further comprising: a third antenna element configured to support a frequency band lower than 20 GHz.

13. The portable communication device of claim 11, wherein the first antenna module is connected with a first ending portion of the third antenna module, and the second antenna module is connected with a second ending portion of the third antenna module.

* * * * *